US007476797B2

(12) United States Patent
Izumisawa et al.

(10) Patent No.: US 7,476,797 B2
(45) Date of Patent: Jan. 13, 2009

(54) RESONANCE GENERATOR

(75) Inventors: Gen Izumisawa, Hamamatsu (JP); Akihiro Fujita, Hamamatsu (JP); Katsushi Ishii, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 11/655,818

(22) Filed: Jan. 18, 2007

(65) Prior Publication Data

US 2007/0175318 A1 Aug. 2, 2007

(30) Foreign Application Priority Data

Jan. 19, 2006 (JP) ..... 2006-011470

(51) Int. Cl.
*G10H 1/08* (2006.01)
*G10H 5/00* (2006.01)

(52) U.S. Cl. ..... 84/660; 84/615; 84/622; 84/625; 84/653; 84/659

(58) Field of Classification Search ..... None
See application file for complete search history.

(56) References Cited

U.S. PATENT DOCUMENTS 4,909,121 A * 3/1990 Usa et al. ..... 84/606
5,256,830 A 10/1993 Takeuchi et al.
5,434,348 A 7/1995 Matsuda et al.
5,583,309 A * 12/1996 Fujita ..... 84/622
5,648,629 A 7/1997 Kozuki
RE35,813 E * 6/1998 Usa et al. ..... 84/606
5,777,255 A 7/1998 Smith, III et al.
5,804,751 A 9/1998 Koseki et al.
6,762,357 B2 * 7/2004 Washiyama et al. ..... 84/603
2001/0027714 A1 * 10/2001 Kondo et al. ..... 84/615

(Continued)

FOREIGN PATENT DOCUMENTS

EP 0 521 537 A2 1/1993

(Continued)

OTHER PUBLICATIONS

Patent Abstract of Japan, Publication No. 09-127941, Published on May 16, 1997, in the name of Koseki, et al.

(Continued)

*Primary Examiner*—Marlon T Fletcher
(74) *Attorney, Agent, or Firm*—Christie, Parker & Hale, LLP

(57) ABSTRACT

According to which a damper is operated before or after keying, one of two resonances is generated. A second waveform storage 18 storing original waveform data of a first resonance based on a music sound including an impact sound of keying according to a before-key-pressing pedaling, and a third waveform storage 19 storing original waveform data of a second resonance based on a music sound which does not include an impact sound of keying according to an after-key-pressing pedaling, are provided. A switch 20 is switched according to the state of the pedal at the time of key pressing to supply selected resonance waveform data to a resonance generating unit 16. The resonance signal outputted from the resonance generating unit 16 and a music sound signal of a direct sound of keying are added by an adder 24 and inputted into a sound system.

40 Claims, 16 Drawing Sheets

U.S. PATENT DOCUMENTS

2007/0084334 A1* 4/2007 Sato ..... 84/626

FOREIGN PATENT DOCUMENTS

JP 9-127941 5/1997
JP 09-127941 5/1997
JP 2004-294832 10/2004

OTHER PUBLICATIONS

Extended European Search Report dated Sep. 25, 2007, for EP 07001025.1. in the name of Kabushiki Kaisha Kawai Gakki Seisakusho.
European Search Report dated Apr. 10, 2007, for EP 07001025.1, in the name of Kabushiki Kaisha Kawai Gakki Seisakusho.

* cited by examiner

OUTPUT OF FIRST HARMONIC OVERTONE RESONANCE CIRCUIT

FIRST HARMONIC OVERTONE + SEVERAL Hz RESONANCE CIRCUIT

RESONANCE CIRCUIT GROUP C OUTPUT

RESONANCE CIRCUIT GROUP C OUTPUT

RESONANCE GENERATOR

CROSS-REFERENCE TO RELATED APPLICATION

This application claims priority of Japanese Patent Application Number 2006-011470, filed on Jan. 19, 2006.

BACKGROUND OF THE INVENTION

1. Field of the Invention

The present invention relates to a resonance generator, more specifically, to a resonance generator which imitates an acoustic piano string resonance generated when a damper pedal is operated.

2. Description of the Related Art

In an acoustic piano, a playing method is used in which operation that a damper pressing a string is released from the string by a damper pedal is performed, and not only a string that was actually pressed but also all other strings are vibrated in response to resonance. In electronic musical instruments such as electronic pianos and electronic organs, a function to imitate string resonance generated in response to this damper pedal operation is required.

For example, a normal sound of a piano without pedaling down its damper pedal and a sound of the piano including resonance when the damper pedal is pedaled down are recorded and their waveform data are stored, and depending on operation of the damper pedal, a waveform is selected to produce a music sound.

There is available another method in which, after the sound of the piano including resonance when the damper pedal is pedaled down is recorded, only harmonic overtone components are removed from this piano sound to generate resonance components, and waveform data of the resonance components are stored, and when the damper pedal is pedaled down, the resonance components are generated together with a normal music sound.

In Japanese Unexamined Patent Publication No. H09-127941, an electronic instrument is proposed in which the electronic instrument includes a resonance memory for storing waveform data of a music sound obtained by removing a reference tone from a music sound including resonance of the reference tone and controls amplitude of the waveform data readout from the resonance memory in response to an instruction generated by the damper pedal operation.

There is also available a method in which, instead of producing a music sound based on waveform data stored in advance, a resonance circuit is constructed by using a digital signal processor (DSP) so as to output a signal forming resonance through the resonance circuit only when the damper pedal is operated.

[Patent Document 1] JP 09-127941 A

In playing accompanying an operation of a damper pedal, key pressing after pedaling down the damper pedal and pedaling down the damper pedal after key pressing are possible. In the conventional technique in which a resonance circuit is constructed by using the DSP, a satisfactory resonance cannot be obtained when the damper pedal is pedaled down after key pressing.

On the other hand, in the electronic instrument using waveform data stored in advance as disclosed in Patent document 1, an amplitude of the waveform data is controlled according to a timing instructed by the damper pedal, so that when the damper pedal is pedaled down after key pressing, it is possible to make smaller the amplitude of the waveform data of the resonance according to an elapsed time until the key pressing from the damper operation and output it.

However, when a key is pressed after the damper pedal is pedaled down, resonance with high intensity caused by the pressing impact sound on the key is generated, and on the other hand, when the damper pedal is pedaled down after key pressing, resonance with low intensity caused by small vibration that does not include a key pressing impact sound is generated. These two kinds of resonances are different in envelope from each other, so that only by reading out data on a single resonance in the operation timing of the damper pedal, resonance with high accuracy cannot be reproduced.

SUMMARY OF THE INVENTION

In view of these problems, an object of the invention is to provide a resonance generator which can generate an appropriate resonance in either the case where a key is pressed after a damper pedal is pedaled down and the case where the damper pedal is pedaled down after a key is pressed.

The invention which solves the above-described problem and achieves the above-described object has a first feature in which a resonance generator including resonance mixing means for synthesizing a direct sound to be outputted in response to a sounding instruction as, for example, a key pressing signal, and resonance based on this direct sound, wherein as the resonance, it is made possible to generate resonance when a key is pressed after a damper pedal is pedaled down and resonance when the damper pedal is pedaled down after a key is pressed so that either of the two resonances is selectively generated according to an operation state of the damper pedal when a key is pressed.

The invention has a second feature in which resonance circuits are provided and a first music sound signal for generating a first resonance in response to key pressing after a damper pedal is pedaled down and a second music sound signal for generating a second resonance in response to pedaling down of a damper pedal after key pressing are inputted into the resonance circuits, where the first music sound signal is a nonperiodic component waveform and harmonic overtone component waveform caused by an impact sound of key pressing, and the second music sound signal is a harmonic overtone component waveform from which the nonperiodic components were removed.

The invention has a third feature in which waveforms of two kinds of resonances prepared in advance are stored, and a waveform is selected according to whether the damper pedal is pedaled down before key pressing or after key pressing to generate resonance.

The invention has a fourth feature in which the level of a direct sound to be produced by key pressing is lowered when the damper pedal is pedaled down.

The invention has a fifth feature in which the resonance circuit has digital filters, and an impulse response thereof is an imitation of a vibration waveform of a harmonic overtone by using a single-degree-of-freedom viscous damping system model.

According to the invention having the first to fifth aspects, resonance can be generated both when a damper pedal is pedaled down before key pressing (generally, before instructing sound generation) and when a damper pedal is pedaled down after key pressing (generally, after instructing sound generation).

Particularly, when the damper pedal is pedaled down before key pressing, a direct sound includes nonperiodic components as an impact sound of the key pressing and harmonic overtone components, however, when the damper pedal is pedaled down after key pressing, the nonperiodic components caused by the impact sound of the key pressing are damped. Such a direct sound change influences the resonance, however, according to the invention, highly accurate resonance in which this influence is taken into account can be generated according to the timing of the operation of the damper pedal.

According to the third feature, either of two resonance waveforms prepared and stored in advance is selected and outputted according to an operation state of the damper pedal, so that processing after the temporary storing of the waveforms is easy.

According to the fourth feature, level lowering of a direct sound which is generated when a damper pedal of a grand piano is pedaled down can be reproduced.

According to the fifth feature, by properly setting parameters of the single-degree-of-freedom viscous damping system model, an arbitrary vibration waveform can be reproduced and desired resonance can be generated.

DETAILED DESCRIPTION OF THE PREFERRED EMBODIMENTS

Figure 2:
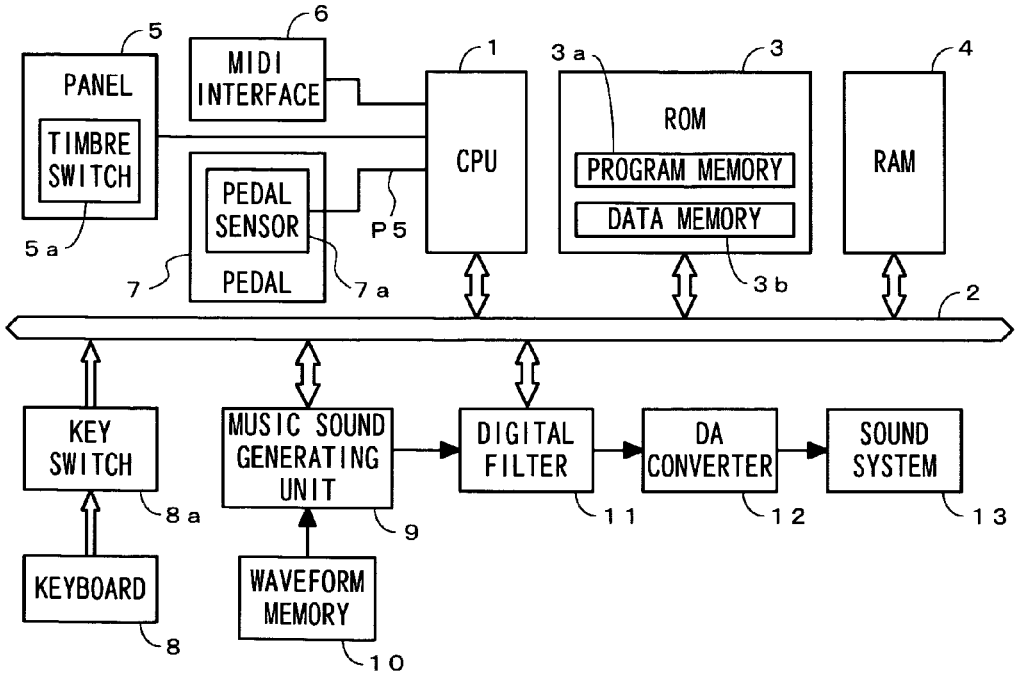
FIG. 2 is a block diagram showing a hardware configuration section of a resonance generator according to an embodiment of the invention.

Hereinafter, the present invention will be described in detail with reference to the drawings. FIG. 2 is a block diagram showing a hardware configuration of an electronic piano including a resonance generator according to an embodiment of the invention. This hardware configuration is common for the second embodiment and the third embodiment described later. In this figure, CPU 1 controls the parts shown in the figure via the system bus 2. ROM 3 includes a program memory 3*a* for storing programs to be used in the CPU 1 and a data memory 3*b* for storing various data including at least timbre data.

RAM 4 temporarily stores various data generated in control by the CPU 1.

The electronic piano is provided with an operation panel (hereinafter, referred to as "panel," simply) 5, a MIDI interface 6, and a damper pedal (hereinafter, referred to as "pedal," simply) 7. The panel 5 is comprised of switches for setting various statuses including a timbre switch 5*a* for selecting a timbre of a music sound to be produced, and information inputted by using this panel 5 is supplied to the CPU 1. The pedal 7 includes a pedal sensor 7*a* which detects an operation (pedaling) state of the pedal 7 and supplies the pedal information to the CPU 1. The pedal sensor 7*a* is a variable resistor, and detects a change in voltage due to a variable resistance as a stepping on depth of the pedal 7. The detected pedaling down depth data of the pedal 7 is sent to the CPU 1. When the CPU 1 receives the pedaling down depth data, it sets a resonance setting flag of "1" on the RAM 4. Then, when this pedaling down depth becomes zero, the pedaling down depth of "0" is sent to the CPU 1 and the resonance setting flag on the RAM 4 is set to "0."

The keyboard 8 is composed of 88 keys, and each key is provided with a key switch 8*a* formed by a touch sensor. The key switch 8*a* detects a player's operation to the keyboard 8 and outputs key information such as a key code KC indicating a pitch corresponds to the pressed key, key-on KON and key-off KOFF for instructing sound producing and vanishing timings of a music sound corresponding to the key pressing and key releasing, and key touch KT corresponding to a key pressing speed. Information outputted from the key switch 8*a* is supplied to the CPU 1 via the system bus 2.

The music sound generating unit 9 is a tone generator with channels to be time-sharing controlled for generating a plurality of sounds at the same time, and accumulates and outputs all output signals of the channels. To the music sound generating unit 9, any one of channels is assigned in response to a key pressing and a music sound corresponding to a key pressing is generated in this channel.

In the waveform memory 10, waveform data of three kinds of music sound information details of which will be described later are stored, and the music sound generating unit 9 reads out waveform data stored in the waveform memory 10 and generates a music sound signal based on the waveform data. The music sound generating unit 9 is for reading out waveform data from the waveform memory 10 in response to a key operation, and reads out waveform data of a timbre set by the timbre switch 5*a* in response to key-on. Stepping for reading out address is performed at a speed corresponding to the key code KC. Namely, waveform data is readout at a reading out rate corresponding to the key code KC.

A music sound signal is filtered through the digital filter 11 and converted into an analog signal in a DA converter 12, and then inputted into a sound system 13. The sound system 13 is comprised of an amplifier and a speaker, etc., and makes the electronic piano produce a sound of an output signal of the DA converter 12 to the outside as an output of the electronic piano.

Main part functions of the above-described electronic piano will be described. The electronic piano of this embodiment has a function to generate two kinds of resonance corresponding to respective case where a key is pressed during pedaling down the pedal 7 (hereinafter, also referred to as "pedaling before key pressing") and the case where the pedal 7 is pedaled down after a key is pressed (hereinafter, also referred to as "pedaling after key pressing"). In the pedaling before key pressing of an acoustic piano, a dampers are released off from the strings when the key is pressed, so that resonance according to vibration including an impact sound of key pressing is generated. On the other hand, in the pedaling after key pressing, a dampers are released off from the strings after the impact sound of key pressing damps or the impact sound is vanished, so that the impact sound of key pressing does not influence the resonance in this case. In this embodiment, two kinds of music sound information for generating resonance corresponding to the characteristics of this acoustic piano are set. Namely, a music sound is generated based on music sound information on a direct sound (hereinafter, referred to as "normal sound") responsive to key pressing and two kinds of resonance information, that is, based on three kinds in total of music sound information. A first resonance system which generates a first resonance when waveform data of a normal sound is inputted, and a second resonance system which generates a second resonance when waveform data of only harmonic overtone components obtained by removing nonperiodic components as an impact sound of key pressing from the normal sound is inputted, are provided. The waveform data are stored in the waveform memory 10.

Figure 1:
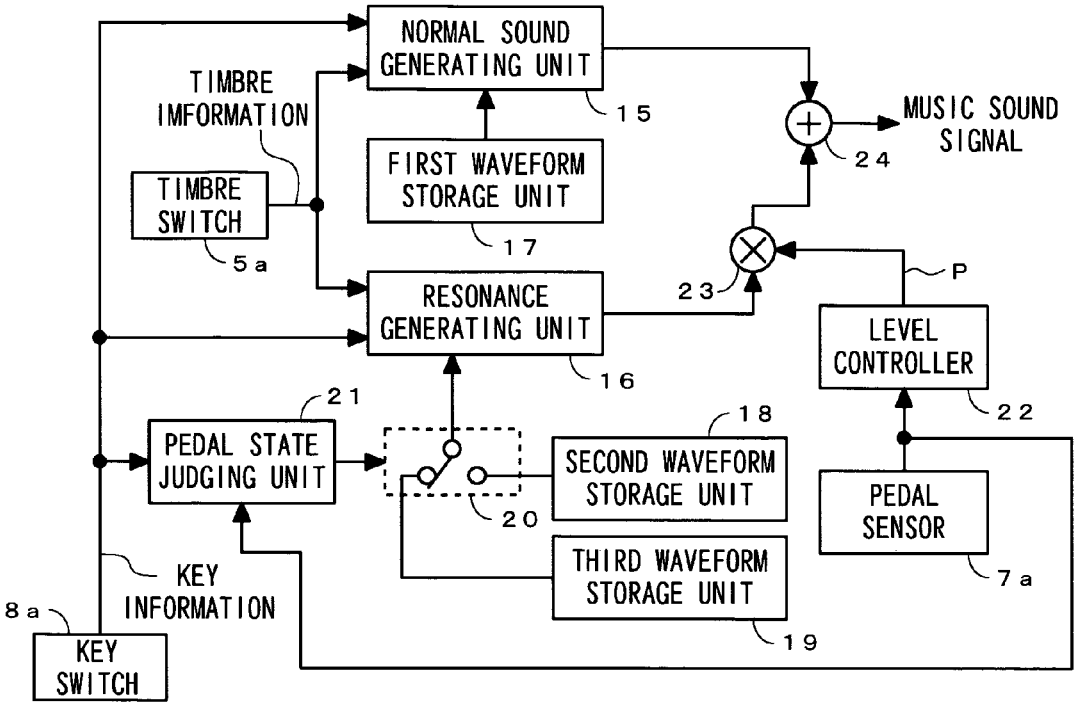
FIG. 1 is a block diagram showing main part functions of a resonance generator according to a first embodiment.

FIG. 1 is a block diagram showing main part functions of the electronic piano according to this embodiment. This electronic piano has a normal sound generating unit 15 and a resonance generating unit 16. The normal sound generating unit 15 and the resonance sound generating unit 16 are functions of the music sound generating unit 9. Normal sound waveform data is inputted into the normal sound generating unit 15 from the first waveform storage unit 17 as a normal sound information supplying unit provided in the waveform memory 10.

Waveform data for resonance generation is read into the resonance generating unit 16 from one selected by a switching unit 20 between a second waveform storage unit 18 and a third waveform storage unit 19. Waveform data stored in the second waveform storage unit 18 is resonance waveform data responsive to a pedaling before key pressing influenced by an impact sound of key pressing. On the other hand, waveform data stored in the third waveform storage unit 19 is waveform data of resonance of harmonic overtone components obtained by removing nonperiodic components as an impact sound of key pressing from a normal sound, that is, waveform data of resonance responsive to a pedaling after key pressing.

The switching unit 20 is switched to a side predetermined in advance according to a result of judgment made by a pedal state judging unit 21. The pedal state judging unit 21 judges an output of the pedal sensor 7*a* when a key-on KON is inputted from the key switch 8*a*. When the key-on KON is inputted, an output of the pedal sensor 7*a* is not less than a predetermined value (pedal-ON reference value) enabling judgment that the pedal has been operated, a before-key-pressing operation detection signal is outputted, and when key-on information is inputted, if the output of the pedal sensor 7*a* is less than the pedal ON reference value, an after-key-pressing operation detection signal is outputted. The switching unit 20 is switched so as to select the second waveform storage unit 18 when the before-key-pressing operation detection signal is inputted, and is switched so as to select the third waveform storage unit 19 when the after-key-pressing operation detection signal is inputted.

The level controller 22 inputs a coefficient P corresponding to the output of the pedal sensor 7*a* into a multiplier 23. When the pedal 7 is pedaling down, the coefficient P is "1," and when the pedal 7 is not pedaling down, the coefficient P is "0." The coefficient P is not limited to the two values of "1" and "0," and may be more finely divided levels according to pedaling down depth on the pedal 7.

An adder 24 which adds a music sound signal from the normal sound generating unit 15 and a music sound signal from the resonance generating unit 16 whose level is adjusted by the coefficient P is provided.

With the above-described construction, when a key is pressed, key information is inputted into the normal sound generating unit 15 and the resonance generating unit 16. Timbre information according to an operation of the timbre switch 5*a* is also inputted into the normal sound generating unit 15 and the resonance generating unit 16. Based on the key information and the timbre information, normal waveform data is read into the normal sound generating unit 15. Based on a result of judgment on an output of the pedal sensor 7*a* made by the pedal state judging unit 21 when key-on KON is detected, the switching unit 20 is switched to either the second waveform storage unit 18 or the third waveform storage unit 19. From the second waveform storage unit 18 or third waveform storage unit 19 selected according to the switching of the switching unit 20, resonance waveform data is read into the resonance generating unit 16 based on the key information and the timbre information.

Based on waveform data on the normal sound and the selected resonance, the normal sound generating unit 15 and the resonance generating unit 16 prepare and output music sound signals. The normal music sound signal is inputted into the adder 24 and the resonance signal is controlled in level according to pedaling (or pedaling down depth) on the pedal by the multiplier 23 and then inputted into the adder 24. Based on the normal music sound signal and resonance music sound signal synthesized by the adder 24, the sound system 13 generates a music sound.

In this embodiment, the pedal state judging unit 21 judges an after-key-pressing pedaling if the output of the pedal sensor 7*a* when the key is on is less than the pedal ON reference value, and reads in waveform data into the resonance generating unit 16 from the third waveform storage unit 19. In this case, if the pedal is not pedaled down until a normal sound is vanished, eventually, due to the level control, resonance is not inputted into the adder 24, so that resonance is not generated, eventually. However, the judging method of the pedal state judging unit 21 may be constituted so that the output of the pedal sensor 7*a* is monitored in duration of key-on KON, and when the output of the pedal sensor 7*a* becomes equal to or more than the pedal ON reference value, an after-key-pressing operation detection signal is outputted.

Figure 3:
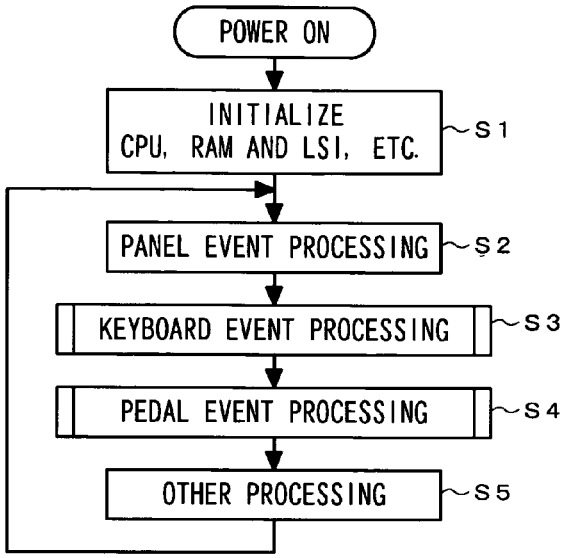
FIG. 3 is a flowchart showing main processing of the resonance generator.

FIG. 3 is a flowchart showing general processing of the electronic piano. At Step S1, the CPU 1, the RAM 4, and a sound source LSI (DSP), etc., are initialized. At Step S2, panel event processing is performed in which the states of the switches on the panel 5 are read-in and corresponding processing is performed. At Step S3, a keyboard event is performed to generate a music sound signal of a normal sound based on the output of the key switch 8*a*. The keyboard event includes setting of an envelope according to the key touch KT.

At Step S4, pedal event processing corresponding to the output of the pedal sensor 7*a* is performed. In the pedal event processing, processings of pedals other than the pedal (damper pedal) may be included. At Step S5, other processings are performed.

Figure 4:
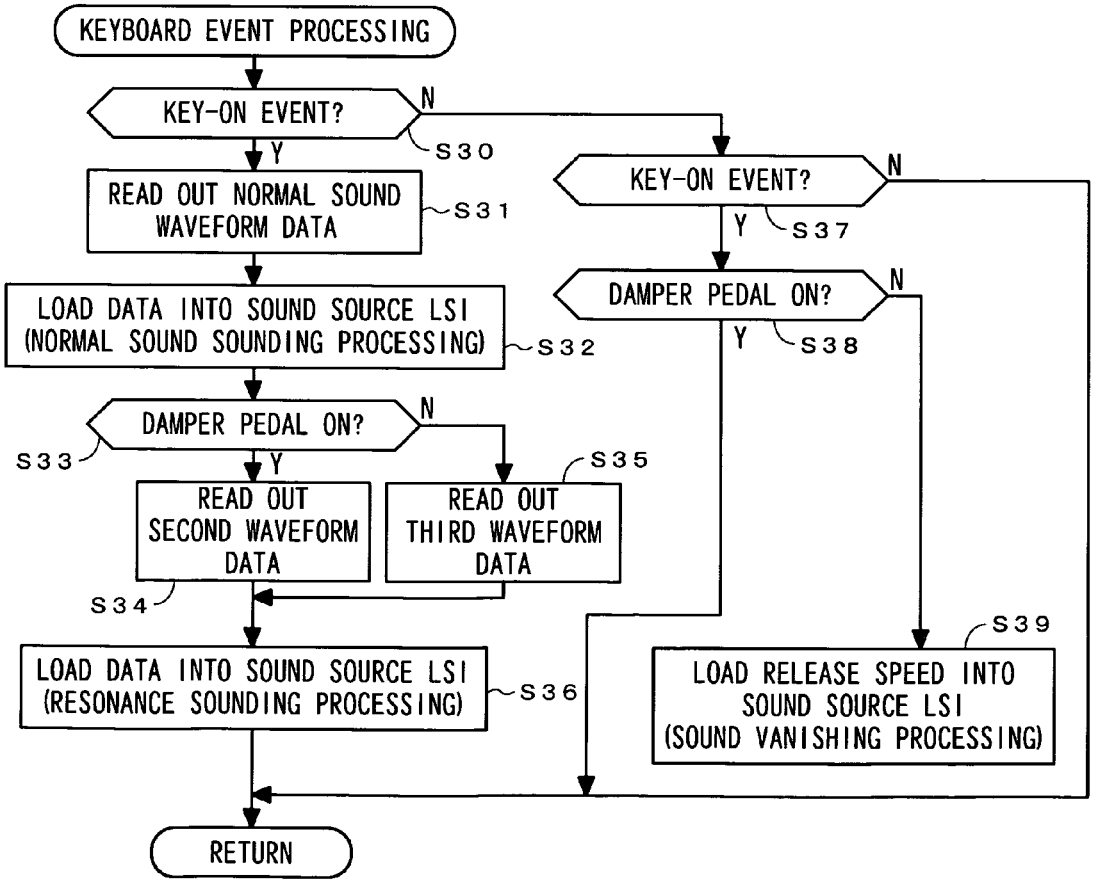
FIG. 4 is a flowchart showing keyboard event processing.

FIG. 4 is a flowchart showing details of the keyboard event processing (Step S3). At Step S30, it is judged whether an ON event of the keyboard 8, that is, a key is pressed based on whether key-on KON is detected. In the case of an ON event, the process advances to Step S31, and normal sound waveform data is readout from the first waveform storage unit 17 according to key information. At Step S32, the readout normal sound waveform data is inputted into the normal sound generating unit 15. Namely, the normal sound waveform data is loaded into the sound source LSI and subjected to normal sound generation processing.

At Step S33, it is judged whether the pedal 7 is pedaled down, that is, whether the output of the pedal sensor 7*a* is not less than the pedal ON reference value. When the pedal 7 is pedaled down, a before-key-pressing operation is judged, and the process advances to Step S34 and waveform data is readout from the second waveform data storage unit 18. When the pedal 7 is not pedaled down, an after-key-pressing operation is judged, and the process advances to Step S35 and waveform data is readout from the third waveform data storage unit 19. At Step S36, the readout second or third waveform data is inputted into the resonance generating unit 16. The waveform data is inputted into the resonance circuit and resonance sounding processing is performed.

On the other hand, when an ON event is not judged at Step S30, the process advances to Step S37, and depending on whether key-off KOFF is detected, it is judged whether an OFF event for the keyboard 8 is performed, that is, whether key releasing is performed. In the case of an OFF event, the process advances to Step S38, and whether the pedal 7 is pedaled down, that is, whether the output of the pedal sensor 7*a* is not less than the pedal ON reference value is judged. When the pedal 7 is pedaled down, the sound that is being generated is kept (sound vanishing processing is not performed).

When the pedal is not pedaled down, the process advances to Step S39 and a release speed is loaded into the sound source LSI to perform sound vanishing processing. Namely, according to the release speed, the level of the music sound signal is gradually lowered.

Figure 5:
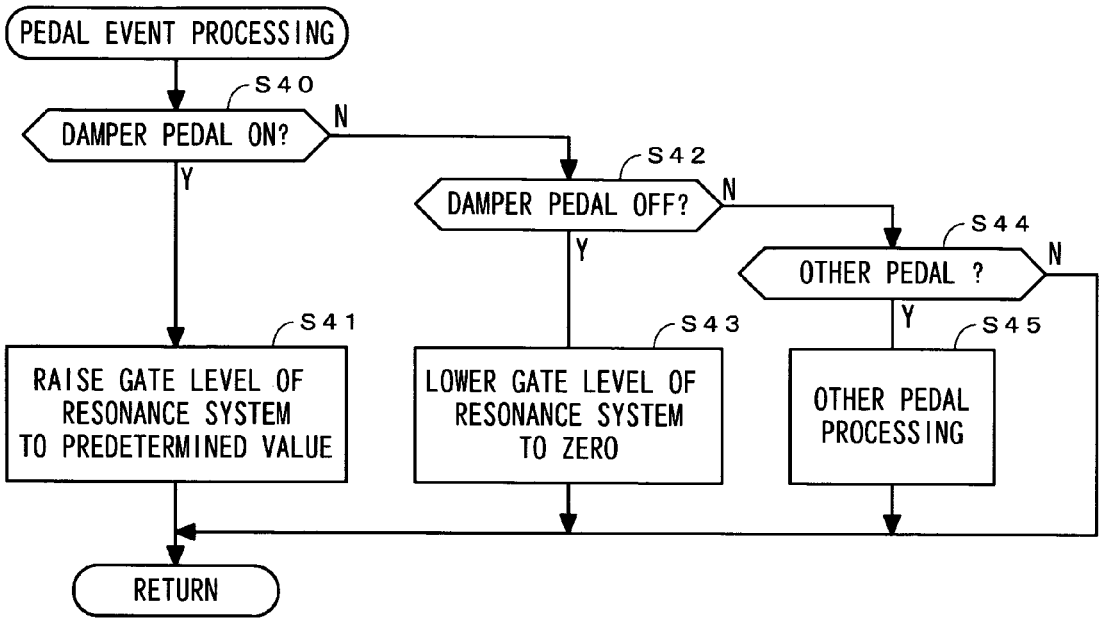
FIG. 5 is a flowchart showing pedal event processing.

FIG. 5 is a flowchart showing details of the pedal event processing (Step S4). At Step S40, it is judged whether the pedal 7 has been pedaled down, that is, whether the output of the pedal sensor 7*a* has been changed from zero. When the pedal 7 is pedaled down, the process advances to Step S41, and according to the coefficient P corresponding to the output value of the pedal sensor 7*a*, the gate level of the resonance system is increased. Namely, the level of the resonance is set by inputting the coefficient P into the multiplier 23.

When the pedal 7 is not pedaled down, the process advances to Step S42, and it is judged whether the pedal 7 has been released off, that is, whether the output of the pedal sensor 7*a* has been lowered to zero. When the pedal 7 is released off, the gate level of the resonance system is increased at Step S43. Namely, the level of the resonance is lowered to zero by inputting the coefficient P (=0) into the multiplier 23.

When the pedal 7 is not released off, the process transfers from Step S42 to Step S44, and it is judged whether a pedal other than the pedal 7 is pedaled down. If the answer of Step S44 is affirmative, processing corresponding to the type of the operated pedal is performed at Step S45.

Figure 6:
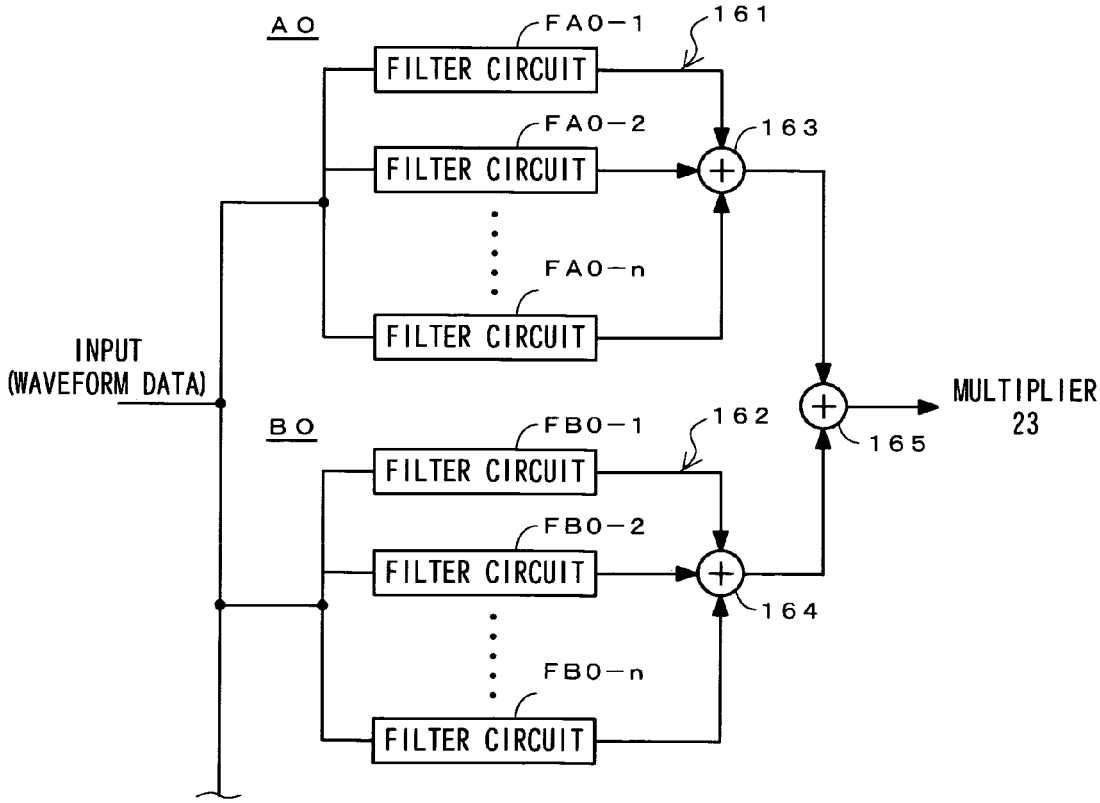
FIG. 6 is a block diagram showing a main part construction of the resonance generator.

The resonance waveform data to be stored in the second waveform storage unit 18 and the third waveform storage unit 19 are the data that are generated in advance in a resonance arithmetic device. FIG. 6 is a block diagram of the resonance arithmetic device. By inputting a normal sound waveform data into this circuit, resonance waveform data is obtained. The resonance arithmetic device is provided with, for each pitch name, n set of filter circuits which generate resonance frequencies corresponding to n number in harmonic overtones composing a music sound of each pitch name. FIG. 6 shows portions corresponding to the pitch names A0 and B0. The resonance circuit 161 has filters FA0-1 for generating a resonance frequency corresponding to a fundamental tone of A0 and filters FA0-2 through FA0-n for generating resonance frequencies corresponding ton number in harmonic overtones. Similarly, the resonance circuit 162 has a filter FB0-1 for generating a resonance frequency corresponding to a fundamental tone of B0 and filters FB0-2 through FB0-n for generating resonance frequencies corresponding to n number in harmonic overtones. Such a resonance circuit is provided corresponding to all pitch names (that is, all keys of the keyboard 8). The adders 163 and 164 synthesize outputs of the resonance circuit 161 and the resonance circuit 162, respectively. The adder 165 synthesizes outputs of unillustrated resonance circuits provided corresponding to all pitch names including the resonance circuits 161 and 162.

In the resonance arithmetic device, from a resonance circuit having a resonance frequency corresponding to a frequency of a harmonic overtone of inputted waveform data, resonance whose amplitude is great is generated, and from a resonance circuit having a resonance frequency different from the frequency of the harmonic overtone of the signal, resonance with a small amplitude is generated. Namely, as the frequency of the harmonic overtone and the resonance frequency move closer to each other, the amplitude of the output from the resonance circuit increases, and as the frequency of the harmonic overtone and the resonance frequency move apart from each other, the amplitude of the output from the resonance circuit becomes smaller. For example, when an input of a sum of waveforms corresponding to strong striking on C3 and G3 is inputted, from resonance circuits with a resonance frequencies close to the harmonic overtone frequencies of the strong striking waveforms of C3 and G3, resonances with great amplitudes are generated, and from resonance circuits with resonance frequencies apart from the harmonic overtone frequencies of the strong striking waveforms of C3 and G3, resonances with small amplitudes are generated. Then, the resonances generated in the resonance circuits are all added by the adder 24.

It is not always necessary to provide resonance circuits corresponding to all keys of the keyboard 8. In an acoustic piano, pitch names to be controlled by the damper pedal are 69 keys of A0 through F6. Therefore, resonance circuits corresponding to at least the 69 keys are provided. To imitate a music sound of an instrument other than the piano, the pitch names are not limited to the range of A0 through F6.

In the construction of FIG. 6, for example, when waveform data of a normal sound of A0 is inputted, the filters of the resonance circuit 161 output resonance music sound information of a fundamental tone and harmonic overtones in response to the inputted waveform data. However, not only does the resonance circuit 161 respond to the waveform data of the normal sound of A0, but filters of other pitch names having the same resonance frequencies as the fundamental sound and harmonic overtone frequencies of A0 or having resonance frequencies slightly shifted from these also respond and output resonance music sound information. For example, the filter having filter characteristics for the second harmonic overtone (441 Hz) of A3 approximate to the fundamental tone (440 Hz) of A4 also outputs resonance music sound information. Resonance music sound information outputted from all of the filters that responded are synthesized by the adder 165 and inputted into the multiplier 23 (see FIG. 1).

Also when waveform data of only harmonic overtone components obtained by removing nonperiodic components as an impact sound of key pressing from a normal sound is inputted, the resonance circuit operates similarly and generates a resonance music sound signal.

Next, the designs of the filters of the resonance circuit will be described. For each filter, an IIR filter is preferably used, which is designed to have characteristics whose output rises sharp in response to an input frequency corresponding to each harmonic overtone frequency. Namely, the impulse response of the filter is an imitation of an oscillatory waveform of a harmonic overtone, and can reproduce by using a single-degree-of-freedom viscous damping system model. For the single-degree-of-freedom viscous damping system model, mass, damped natural frequency, and damping rate are used as model parameters, and based on these, a coefficient of viscosity and a coefficient of rigidity which become coefficients of a dynamic equation of the single-degree-of-freedom viscous damping system model are calculated. Furthermore, the dynamic equation is Laplace-transformed to obtain a transfer function equation of s-representation. The coefficient of viscosity, the coefficient of rigidity, and the mass are assigned to this transfer function equation and subjected to bilinear transformation to obtain a filter coefficient of z-representation.

A filter coefficient is calculated as a function of the mass, the damped natural frequency, and the damping rate, in which the mass is an arbitrary value and the damped natural frequency is a frequency of a harmonic overtone to be imitated, and the damping rate corresponds to an exponent when damping of the harmonic overtone is approximated by exponential function.

One filter is designed so as to imitate a fluctuation with time of a harmonic overtone, however, if it sufficiently imitates a fluctuation in resonance frequency or amplitude with time, the circuit scale becomes excessively large, so that it is designed to substantially imitate the fluctuation with time.

Figure 7:
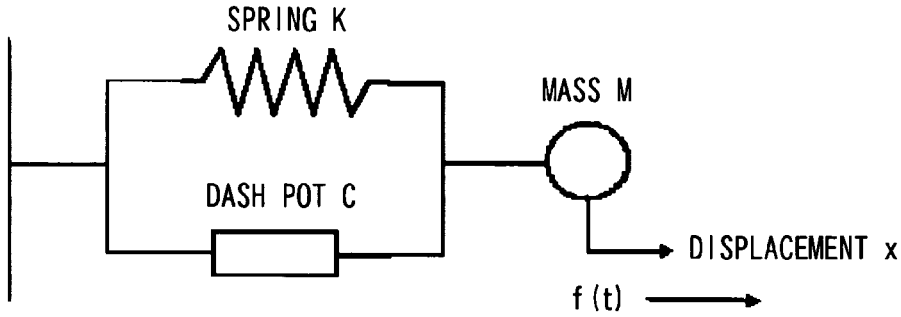
FIG. 7 is a model explanatory view showing a single-degree-of-freedom viscous damping system model.

FIG. 7 is a schematic diagram showing a single-degree-of-freedom viscous damping system model. The single-degree-of-freedom viscous damping system model is expressed by a spring (coefficient of rigidity) K, a mass M, and a dash pot (coefficient of viscosity) C. The viscosity is also called damper, however, to prevent confusion with the damper pedal, the term "dash pot" is used. The dynamic equation of this model when the displacement of the mass M is defined as x and the force applied to the mass M is defined as f(t) is as shown in the following Equation 1.

$$M\frac{d^2x(t)}{dt^2}+C\frac{dx(t)}{dt}+Kx(t)=f(t) \quad \text{[Equation 1]}$$

Furthermore, Equation 1 is Laplace-transformed and its transfer function is calculated as shown in equation 2. The numerator of the transfer function equation of equation 2 is composed of only a constant term, and the denominator is composed of a quadratic polynomials. Therefore, the equation 2 can be realized by a secondary low-pass filter.

$$Ms^2X(s)+CsX(s)+KX(s)=F(s) \quad \text{[Equation 2]}$$

$$G(s)=\frac{X(s)}{F(s)}=\frac{1}{Ms^2+Cs+K}$$

The coefficients for expressing the behavior of the single-degree-of-freedom viscous damping system model and a relational equation thereof are generally known, and are as shown in equations 3 to 7 provided that an undamped natural angular frequency is defined as ω, a critical damping coefficient is defined as cc, a damping ratio is defined as ζ, a damping coefficient is defined as σ, and a damped angular frequency is defined as ωd.

$$\Omega=\sqrt{K/M} \quad \text{[Equation 3]}$$

$$c_c=2M\Omega \quad \text{[Equation 4]}$$

$$\zeta=C/c_c \quad \text{[Equation 5]}$$

$$\sigma=\Omega\cdot\zeta \quad \text{[Equation 6]}$$

$$\omega_d=\Omega\sqrt{1-\zeta^2} \quad \text{[Equation 7]}$$

The damped angular frequency ωd is obtained by multiplying a harmonic overtone frequency to be imitated by 2π, and the damping ratio σ is an exponent used when damping of a harmonic overtone to be imitated is approximated by an exponential function. The mass M is an arbitrary value, and is "1," herein. Thus, when making known the damped natural angular frequency ωd, the damping ratio σ, and the mass M, they are coefficients of the polynomial of the denominator of the transfer coefficient G(s). The coefficient of viscosity C and the coefficient of rigidity K are calculated by equation 8 that is obtained by assigning a transformation of equation 6 and equation 4 to equation 5.

$$\frac{\sigma}{\Omega} = \frac{C}{2M\Omega} \quad \text{[Equation 8]}$$

Therefore, the coefficient of viscosity C is as shown in equation 9.

$$C=2M\sigma \quad \text{[Equation 9]}$$

The damped natural angular frequency ωd is a value obtained by multiplying the resonance frequency of the resonance circuit portion by 2π (namely, the damped natural angular frequency (rad) =resonance frequency (Hz)). When equation 4 is assigned to equation 7, equation 10 is obtained.

$$\omega_d = \Omega\sqrt{1 - \frac{C^2}{4M^2\Omega^2}} \quad \text{[Equation 10]}$$

Equation 11 is obtained by solving Equation 10 for Ω.

$$\Omega = \sqrt{\omega_d^2 + \frac{C^2}{4M^2}} \quad \text{[Equation 11]}$$

Furthermore, by assigning Equation 11 to Equation 3, the coefficient of rigidity is obtained by Equation 12.

$$K=\Omega^2 \cdot M \quad \text{[Equation 12]}$$

Thereby, all transfer coefficients of s-representation are determined.

For further realizing this by digital filter, a transfer function equation of z-representation is obtained by bilinear transformation. Bilinear transformation means transformation of s into Equation 13. In Equation 13, T indicates a sampling time, and z indicates unit delay.

$$s=2/T\{(1-z^{-1})/(1+z^{-1})\} \quad \text{[Equation 13]}$$

Equation 14 is obtained by assigning Equation 13 to Equation 2.

$$\frac{1}{Ms^2 + Cs + K} = \frac{1}{M[2/T \cdot \{(1 - z^{-1})/(1 + z^{-1})\}]^2 + C \cdot 2/T \cdot \{(1 - z^{-1})/(1 + z^{-1})\} + K} = \frac{(1 + z^{-1})^2}{M\{2/T \cdot (1 - z^{-1})\}^2 + C \cdot 2/T \cdot \{(1 - z^{-1})(1 + z^{-1})\} + K(1 + z^{-1})^2} \quad \text{[Equation 14]}$$

Herein, the mass M, the coefficient of viscosity C, and the coefficient of rigidity K are arranged as Equation 15 through Equation 17.

$$M\{2/T\cdot(1-z^{-1})\}^2=4M/T^2(1-2z^{-1}+z^{-2}) \quad \text{[Equation 15]}$$

$$C\cdot 2/T\cdot\{(1-z^{-1})(1+z^{-1})\}=2C/T(1-z^{-2}) \quad \text{[Equation 16]}$$

$$K(1+z^{-1})^2=K(1+2z^{-1}+z^{-2}) \quad \text{[Equation 17]}$$

Herein, Equation 2 indicating a transfer function equation is expressed as Equation 18.

$$\frac{1}{Ms^2 + Cs + K} = \frac{1 + 2z^{-1} + z^{-2}}{b0 + b1 \cdot z^{-1} + b2z^{-2}} \quad \text{[Equation 18]}$$

The coefficients of the denominator polynomial are determined as Equation 19 from Equation 15 through Equation 17.

$$b0 = 4M/T^2 + 2C/T + K \quad \text{[Equation 19]}$$

$$b1 = -\frac{8M}{T^2} + 2K$$

$$b2 = \frac{4M}{T^2} - \frac{2C}{T} + K$$

As described above, the filters of the resonance circuit are realized by making known the damped natural angular frequency ωd, the damping rate σ, and the mass M.

Subsequently, a method for determining the damped natural angular frequency ωd and the damping rate σ will be described. The damped natural angular frequency ωd is a value obtained by multiplying a harmonic overtone frequency to be imitated by 2π, and this harmonic overtone frequency can be obtained by a known method such as FFT analysis or extraction from a music sound by using a band-pass filter.

Figure 8:
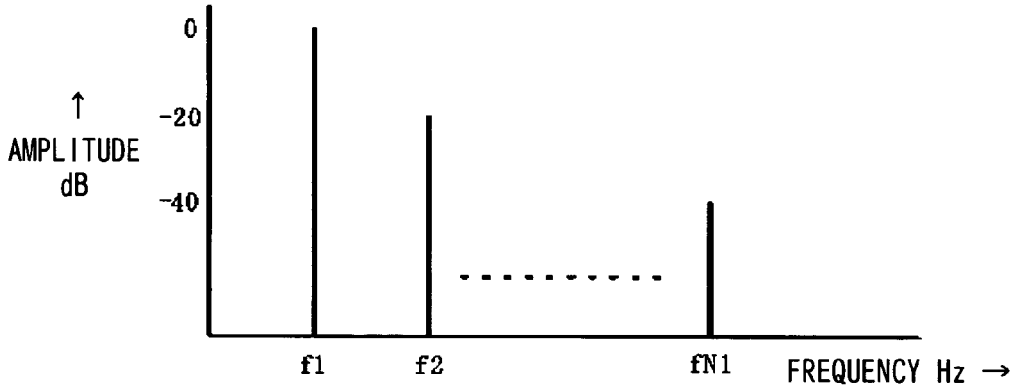
FIG. 8 is a graph showing amplitude-frequency characteristics by means of FFT analysis.

FIG. 8 is a schematic diagram showing amplitude-frequency characteristics of a music sound of A0 obtained by FFT analysis. In the figure, f1 indicates a frequency of the first harmonic overtone (fundamental tone) of A0, f2 indicates a frequency of the second harmonic overtone, and fN1 is a frequency of the highest-order harmonic overtone. The damped natural angular frequency ωd of the filter FA0-1 in FIG. 6 is f1×2π. Likewise, the natural angular frequency ωd of the filter FA0-2 is 2×2π, and the natural angular frequency ωd of the filter FA0-n is fN1×2π.

As the damping rate σ, a damping rate σ which minimizes the least squared error based on the waveform of a harmonic overtone and Equation 20 is used. In the music sound of A0, the damping rate σ is set so that the difference between the waveform (see FIG. 9) of the first harmonic overtone and the waveform (see FIG. 10) approximated to the waveform of FIG. 9 by Equation 20 becomes minimum.

$$x(t)=A\cdot e^{-\sigma\cdot t}\cos\omega_d\cdot t \quad \text{[Equation 20]}$$

In Equation 20, x(t) indicates an instantaneous value of sine wave, and A indicates an amplitude. The amplitude A is a maximum amplitude of a harmonic overtone to be approximated.

Figure 9:
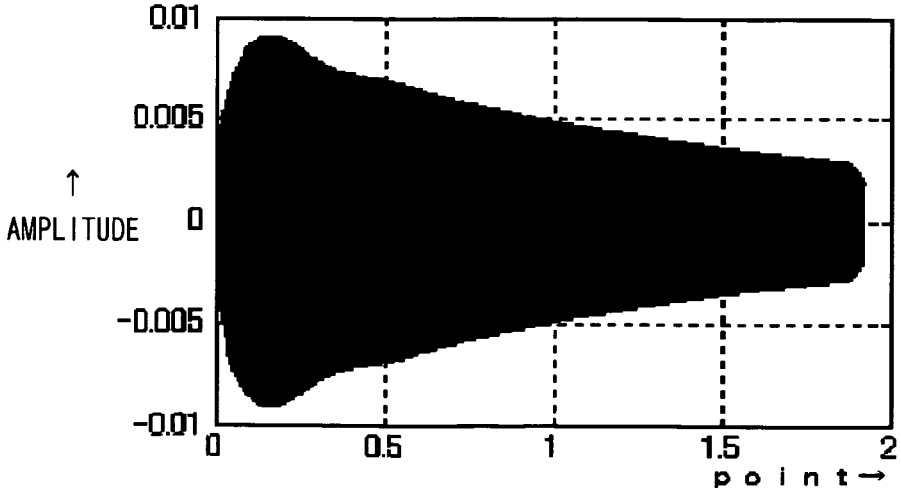
FIG. 9 is a waveform chart showing the first harmonic overtone of A0 sound.
Figure 10:
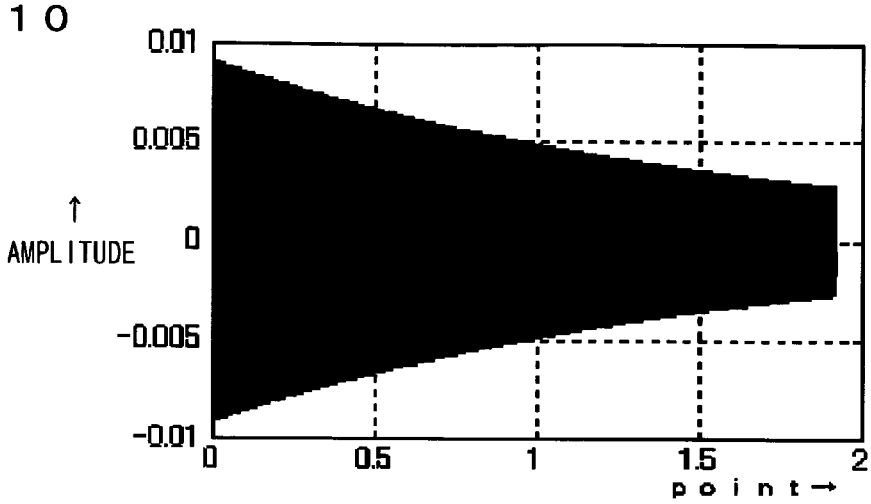
FIG. 10 is a waveform chart showing an approximate waveform of the first harmonic overtone of A0 sound.

Other than the above-described method, a method in which an envelope of harmonic overtone is extracted and approximated by using a logarithmic function may also be used. FIG. 9 shows a real waveform of the first harmonic overtone A0, and FIG. 10 shows a waveform of the first harmonic overtone of A0 approximated by Equation 20.

The method for determining the least squared error and the analysis by means of FFT are known, so that their description is omitted.

Timbre can be set by connecting in series a multiplier to each filter provided in the resonance circuits 161 and 162. The multiplier coefficient in this case can be determined based on the results of FFT analysis of the music sound waveform. A music sound waveform of A0 having the amplitude-frequency characteristics shown in FIG. 8 is described by way of example.

In FIG. 8, concerning the first harmonic overtone, the frequency thereof is f1 Hz and the amplitude level thereof is 0 dB, and concerning the second harmonic overtone, the frequency thereof is f2 Hz and the amplitude level thereof is −20 dB. Concerning the N1 (highest-order) harmonic overtone, the frequency thereof is fN1 Hz and the amplitude level thereof is −40 dB.

Therefore, as an amplitude ratio, when the first harmonic overtone is 1 (reference), the second harmonic overtone is 10(−20/20)=0.1, and the N1 harmonic overtone is 10(−40/20)=0.01. Therefore, the multiplier coefficient of the multiplier to be connected to the filter FA0-1 of FIG. 6 is "1," the multiplier coefficient of the multiplier to be connected to the filter FA0-2 is "0.1," and the multiplier coefficient of the multiplier to be connected to the filter FA0-n is "0.01."

Next, a harmonic overtone to be imitated will be described. In an electronic piano, music sound waveforms of an acoustic piano are collected with microphone and the collected waveforms are stored in the waveform memory 10. Therefore, to specify a resonance frequency of a resonance circuit or determine a damping rate, based on the collected waveforms, a harmonic overtone to be imitated is extracted and used.

For example, when the first harmonic overtone of A0 is imitated, cutting-out from an A0 music sound waveform is performed with a band-pass filter which has a bandwidth less than f1 is performed around the f1 harmonic overtone and a resonance frequency is specified by zero-cross analysis and approximation of damping is performed.

Figure 11:
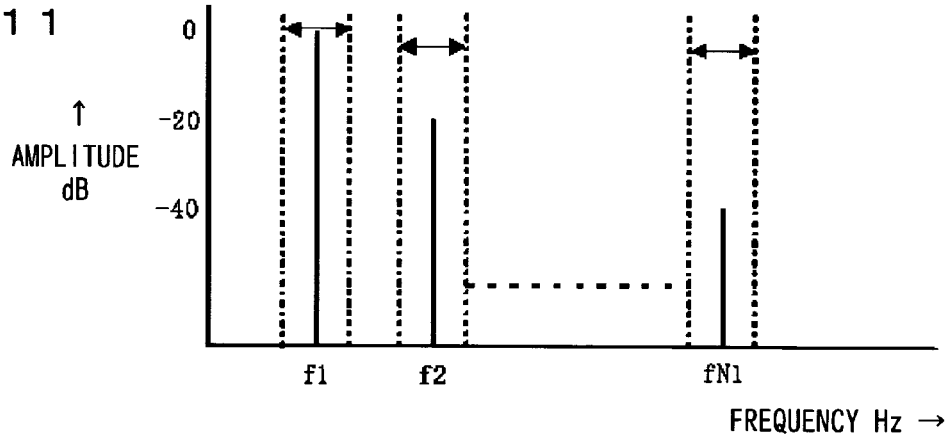
FIG. 11 is a graph showing examples of bandwidths for extracting harmonic overtones.

FIG. 11 is a diagram showing the bandwidth of the band-pass filter. The range shown by the arrow is the pass-through range of the band-pass filter.

For the music sound generating unit 9, a music-sound synthesis method can be used instead of waveform reading. In this case, a music sound generated from the music sound generating unit 9 based on key information regarded as music sound control information is collected, and as concerns this, a resonance frequency is specified by FFT analysis or zero-cross analysis and approximation of damping is performed. Namely, a harmonic overtone to be imitated is a harmonic overtone extracted from a music sound waveform synthesized according to predetermined music sound control information and outputted.

In this embodiment in which the resonance frequency and the damping rate are determined by extracting harmonic overtones from real piano sounds, in comparison with the conventional case where resonance is generated by using a delay loop, the following advantages are obtained.

Harmonic overtones of a real piano sound do not have frequencies being integral multiples of a fundamental tone, exactly, and have slight deviations. It is known that if the order of the harmonic overtone becomes higher, the frequency shifts to the higher side from the integral multiple of the fundamental tone. In addition, a harmonic overtone may be missing where it should be. To the contrary, a harmonic overtone is present where the harmonic overtone hardly arises. Thus, each piano has individuality.

A conventional resonance circuit using a delay loop accurately resonates with a frequency being an integral multiple of a reciprocal of the delay time, so that it cannot adapt to the individuality of each piano. On the other hand, in this embodiment, harmonic overtones of real piano sounds are extracted one by one to design the resonance circuits, so that the harmonic overtones of real piano sounds can be correctly reproduced.

In the resonance circuit, for an inputted music sound, filter circuits are prepared as many as the number of harmonic overtones of the music sound regarded as a fundamental tone. The resonance frequency of one filter corresponds to one harmonic overtone frequency, however, if there are a plurality of harmonic overtones with harmonic overtone frequencies equal to or very close to each other, one harmonic overtone frequency can represent the others.

For example, when a music sound fundamental tone frequency of a certain pitch name is f1 Hz, the second harmonic overtone thereof is (f1×2) Hz, the third harmonic overtone is (f1×3) Hz, and the fourth harmonic overtone is (f1×4) Hz. Then, the fundamental tone frequency of a music sound one octave higher than said music sound is (f1×2) Hz, and the second harmonic overtone thereof is (f1×4) Hz. The fundamental frequency of a music sound two octaves higher is (f1×4) Hz. Therefore, the second harmonic overtone of a music sound of a certain pitch name and a fundamental tone frequency of a one octave higher music sound substantially overlap each other. Similarly, the fourth harmonic overtone of a music sound of a certain pitch name, the second harmonic overtone of the one-octave higher sound, and the two-octave higher fundamental tone frequency overlap each other. Even out of the octave relationship, harmonic overtone frequencies of different orders of different pitch names are very close to each other in some cases.

Thus, for the harmonic overtones whose frequencies are substantially equal to each other, instead of providing filters for each frequency, one filter is provided for one harmonic overtone or a filter with a resonance frequency set to an average frequency is provided. Thereby, the scale of the resonance circuit can be reduced.

Figure 12:
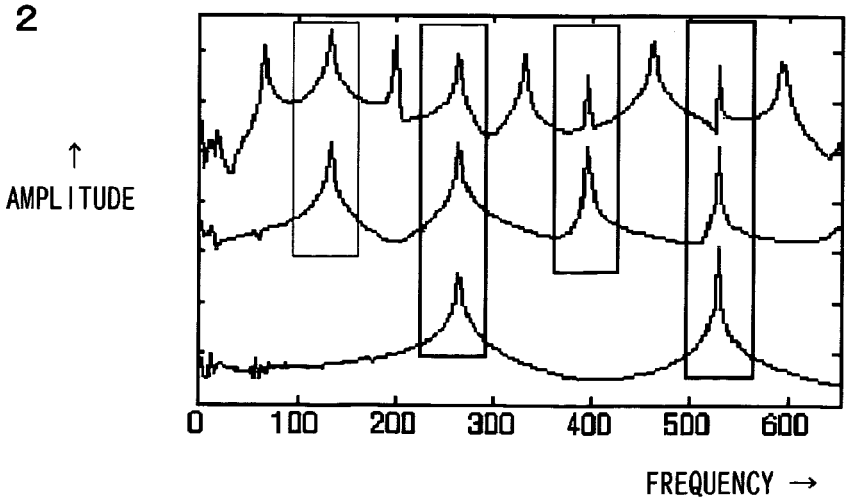
FIG. 12 is a graph showing amplitude-frequency characteristics in FFT analysis of harmonic overtones of C2, C3, and C4 sounds.

FIG. 12 is a diagram showing the results of FFT analysis on harmonic overtones of music sounds of a plurality of pitch names. In FIG. 12, the upper line indicates harmonic overtones of C2, the middle line indicates harmonic overtones of C3, and the lower line indicates harmonic overtones of C4. The harmonic overtone sections enclosed by rectangles in the figure can be made by one filter each.

When the frequency of a harmonic overtone included in a music sound to be inputted into the filter and the resonance frequency of the filter are very close to each other, in comparison with the case where the frequency of the harmonic overtone included in the music sound to be inputted into the filter and the resonance frequency of the filter into which the music sound is inputted are different from each other, the resonance to be outputted from the former filter becomes greater. Namely, when the harmonic overtone frequency of a music sound and the resonance frequency of the filter are close to each other, the amplitude of the filter output becomes excessively great. In this case, the output sound is not as originally desired as resonance but sounds like a stable music sound with this resonance frequency. An example is shown next.

Figure 13:
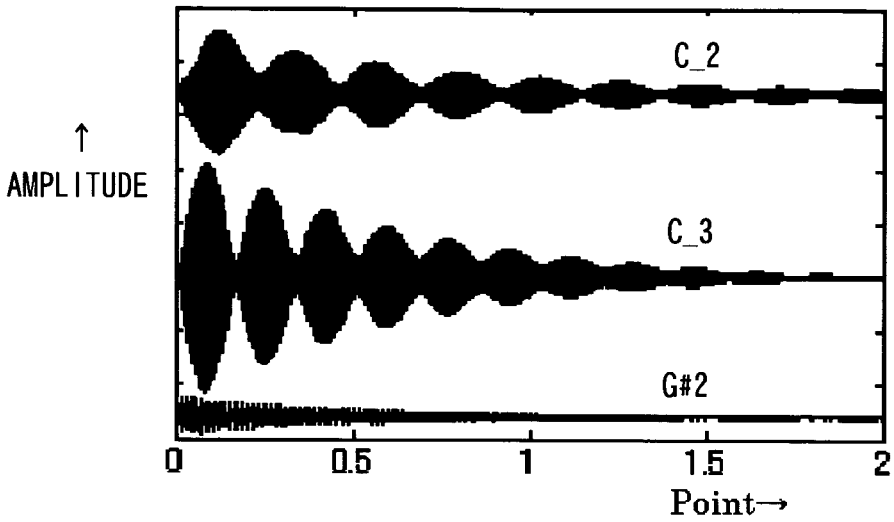
FIG. 13 is a graph showing states of resonances when a music sound of C2 is inputted into first harmonic overtone resonance circuits of C2, C3, and G#2 sounds.

FIG. 13 shows, in order from the upper side, music sound signals of resonances to be outputted from filters when a music sound of C2 is inputted into the first harmonic overtone filter of C2, the first harmonic overtone filter of C3, and the first harmonic overtone filter of G#2, respectively. As shown in this figure, music sound signals of resonances to be outputted from the first harmonic overtone filter of C2 and the first harmonic overtone filter of C3 are great. This is because the music sound of C2 has harmonic overtones whose frequencies are very close to frequencies of the first harmonic overtone of C2 and the first harmonic overtone of C3. In this case, resonance sound sounds as if the music sound of C2 is sounded.

To avoid such unnaturalness, the resonance frequency of a filter corresponding to a specific harmonic overtone frequency is shifted by a predetermined depth. To set the amplitudes of the resonances shown in FIG. 13 to substantially the same amplitude, the resonance frequencies of the filters are slightly shifted from the harmonic overtone frequencies.

Figure 14:
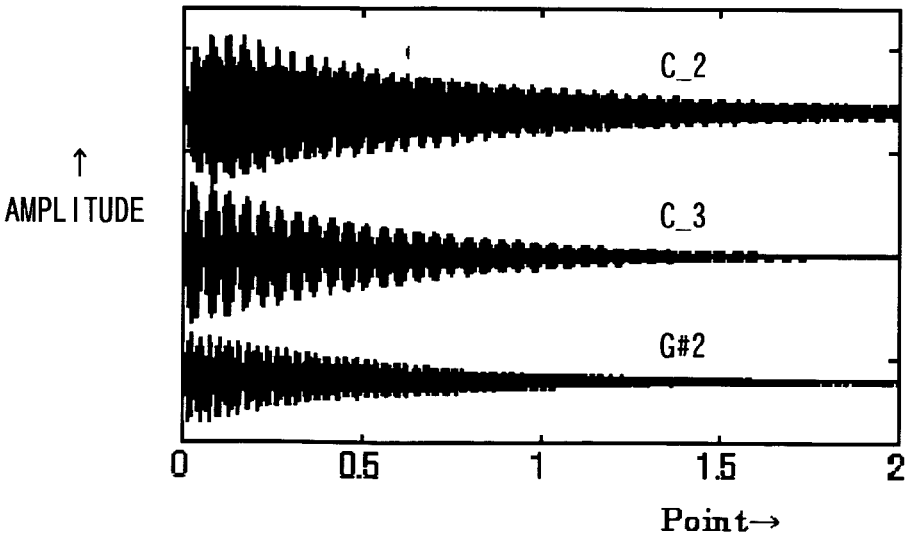
FIG. 14 is a graph showing states of resonances when a music sound of C2 is inputted into resonance circuits with resonance frequencies shifted by several Hz from first harmonic overtones of C2, C3, and C#2 sound.

The results obtained when the resonance frequencies of the filters are slightly shifted from the harmonic overtone frequencies are shown in FIG. 14. FIG. 14 shows, in order from the upper side, resonances obtained when a music sound of C2 is inputted into a filter whose resonance frequency is shifted by several Hz from the first harmonic overtone of C2, a filter whose resonance frequency is shifted by several Hz from the first harmonic overtone of C3, and a filter whose resonance frequency is shifted by several Hz from the first harmonic overtone of G#2. As seen in this figure, by slightly shifting the resonance frequencies of the filters, the amplitudes of the resonances can be set to substantially the same amplitude.

Figure 15:
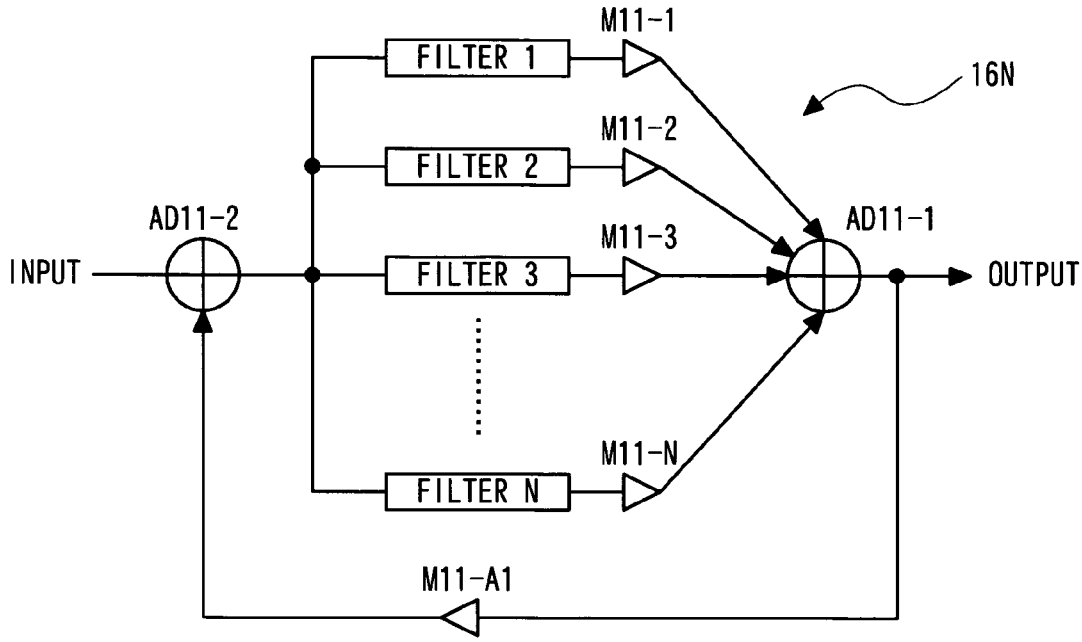
FIG. 15 is a diagram showing a construction in which a feedback path is added to a resonance generating unit.

In a piano, string vibration is transmitted to a soundboard and outputted therefrom. At the same time, the vibration is transmitted to other strings through a bridge. Furthermore, vibrations transmitted to other strings are transmitted to the original string again through a bridge. To reproduce this feedback circuit by an electronic piano, a feedback path is provided in the resonance circuit. FIG. 15 shows an example of a resonance circuit having a feedback path. This example shows a case where a multiplier is provided after each filter. Outputs of the filters of the resonance circuit 16N are level-controlled by the multipliers M11-1 through M11-n and further added to the original inputted music sound by the adder AD11-2, and then fed back to this resonance circuit 16N again.

In addition to the construction to feedback to the resonance circuit, a circuit for delaying an output of the resonance circuit by a predetermined time and/or a second filter for changing the amplitude-frequency characteristics of the output of the resonance circuit may be provided in the feedback path.

Figure 16:
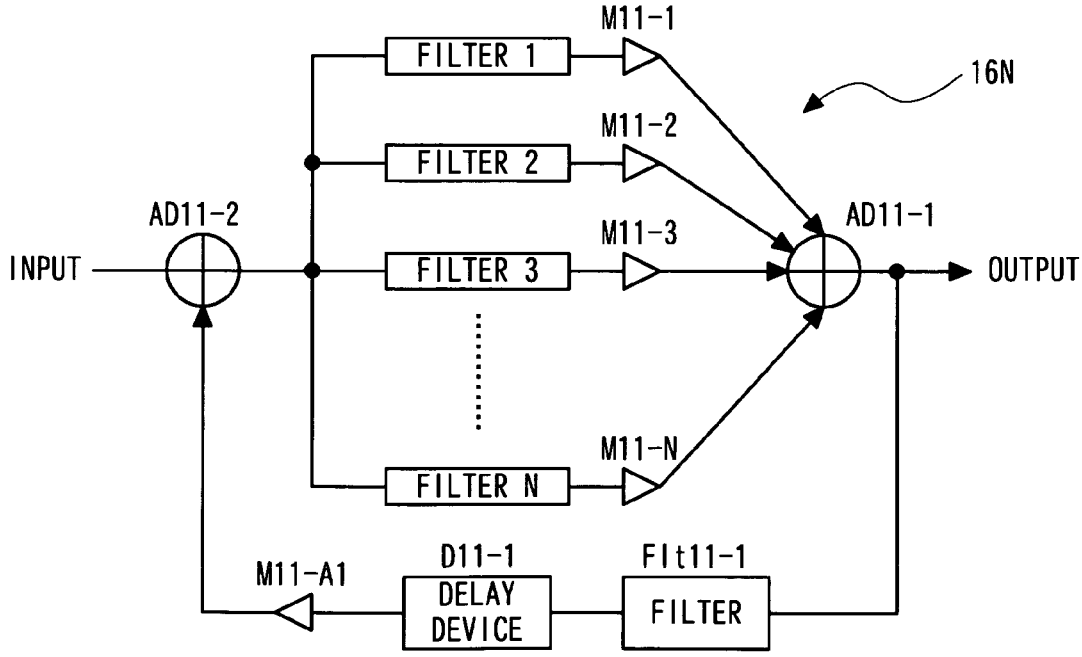
FIG. 16 is a diagram showing a construction in which a feedback path, a delay circuit, and a filter for changing amplitude-frequency characteristics are added to resonance generating means.

For example, as shown in FIG. 16, in the feedback path to the resonance circuit 16N, a delay device D11-1 for delaying an output of the resonance circuit 16N by a predetermined time and a second filter Flt11-1 for changing the amplitude-frequency characteristics of the output of the resonance circuit 16N are provided. In this case, the delay circuit imitates propagation delay of vibration, and the second filter Flt11-1 imitates transmission characteristics of the bridge.

Next, a second embodiment of the invention will be described.

Figure 28:
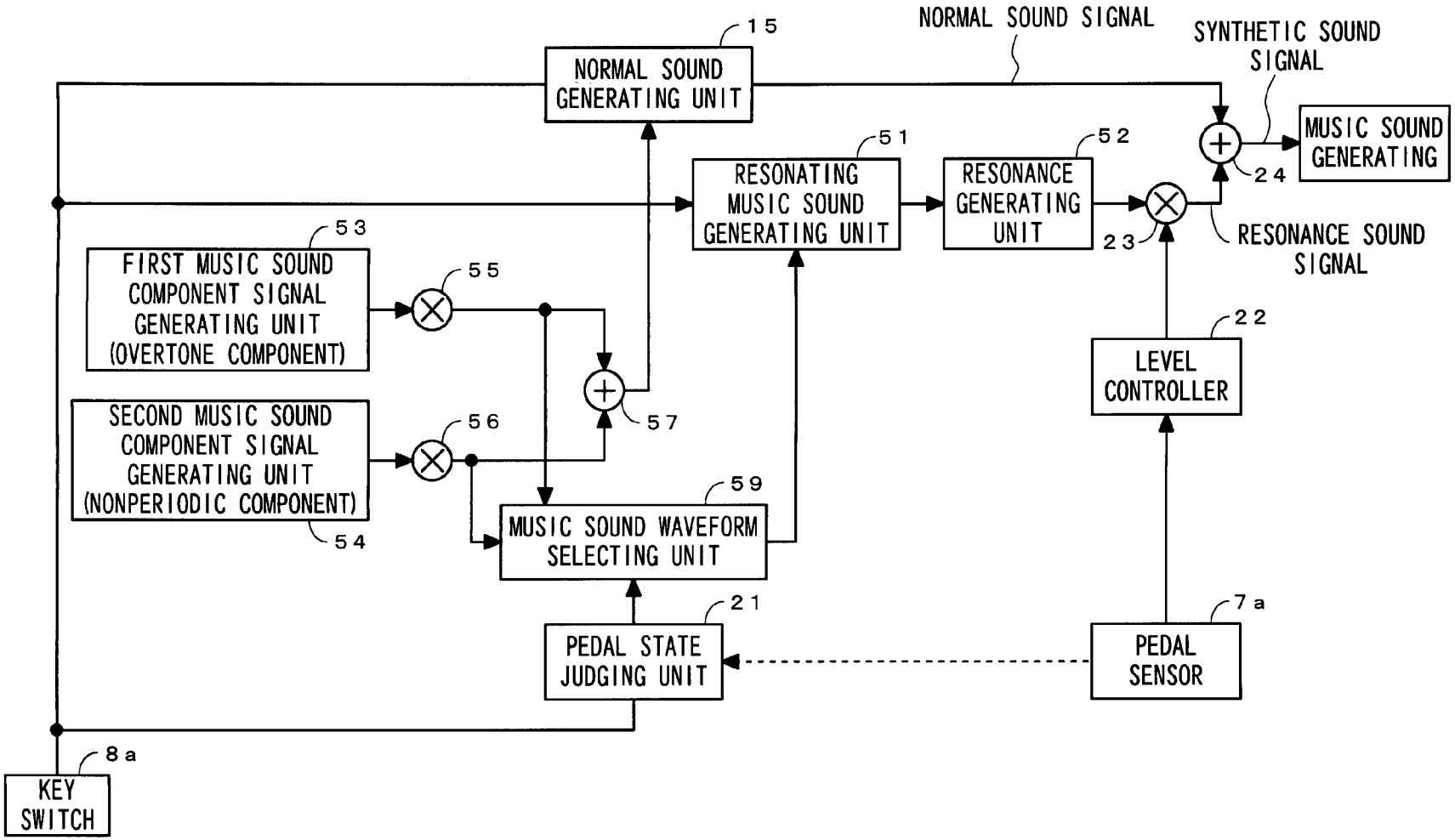
FIG. 28 is a block diagram showing functions of a real time resonance generator.

FIG. 28 is a block diagram showing main part functions of a resonance generator which uses a resonance real time generation method according to a second embodiment, wherein the same reference numerals as in FIG. 1 denote identical or equivalent portions. In the same figure, a normal sound generating unit 15, a resonating music sound generating unit 51, and a resonance generating unit 52 are provided. On the output side of the resonance generating unit 52, a multiplier 23 as resonating music sound level control means is provided, and on the output sides of the multiplier 23 and the normal sound generating unit 15, an adder 24 is provided.

A first music sound component signal generating unit 53 in which harmonic overtone components are stored in advance as a first music sound component signal and a second music sound component signal generating unit 54 in which nonperiodic components are stored in advance as a second music sound component signal are provided. On the output sides of the first music sound component signal generating unit 53 and the second music sound component signal generating unit 54, multipliers 55 and 56 which control the level of an input signal in response to key touch KT are provided, respectively. On the output sides of the multipliers 55 and 56, an adder 57 is provided, and the output side of the adder 57 is connected to the normal sound generating unit 15.

The output sides of the multipliers 55 and 56 are connected to the resonating music sound generating unit 51 via a music sound waveform selecting unit 59.

In the construction of FIG. 28, when key information as a sound generating instruction is inputted from the key sensor 8*a*, a first music sound component signal which was readout from the first music sound component signal generating unit 53 and controlled in level by the multiplier 55 and a second music sound component signal which was readout from the second music sound component signal generating unit 54 and controlled in level by the multiplier 56 are added and synthesized by the adder 57, and inputted into the normal sound generating unit 15. The normal sound generating unit 15 generates a normal music sound signal based on the inputted music sound component signal.

On the other hand, the first music sound component signal which was readout from the first music sound component signal generating unit 53 and controlled in level by the multiplier 55 and the second music sound component signal which was readout from the second music sound component signal generating unit 54 and controlled in level by the multiplier 56 are inputted into the resonating music sound generating unit 51 in response to switching of the music sound waveform selecting unit 59. When the pedal state judging unit 21 judges a before-key-pressing operation of the pedal 7, both of the first music sound component signal and the second music sound component signal are readout by the resonating music sound generating unit 51, and when an after-key-pressing operation is judged, only the first music sound component signal is selected and readout by the resonating music sound generating unit 51. The resonating music sound generating unit 51 generates a resonating music sound signal based on the inputted music sound component signal. The resonating music sound signal is supplied to the resonance generating unit 52, and the resonance generating unit 52 generates a resonance signal according to the inputted resonating music sound signal. The resonating music sound signal is controlled in level according to a pedaling down depth of the pedal 7 and then inputted into the adder 24, and synthesized with the normal music sound signal and outputted. The normal sound generating unit 15 and the resonating music sound generating unit 51 are constituted by known music sound generating means, and the resonance generating unit 52 is constituted by the above-described resonance generating circuit.

Figure 29:
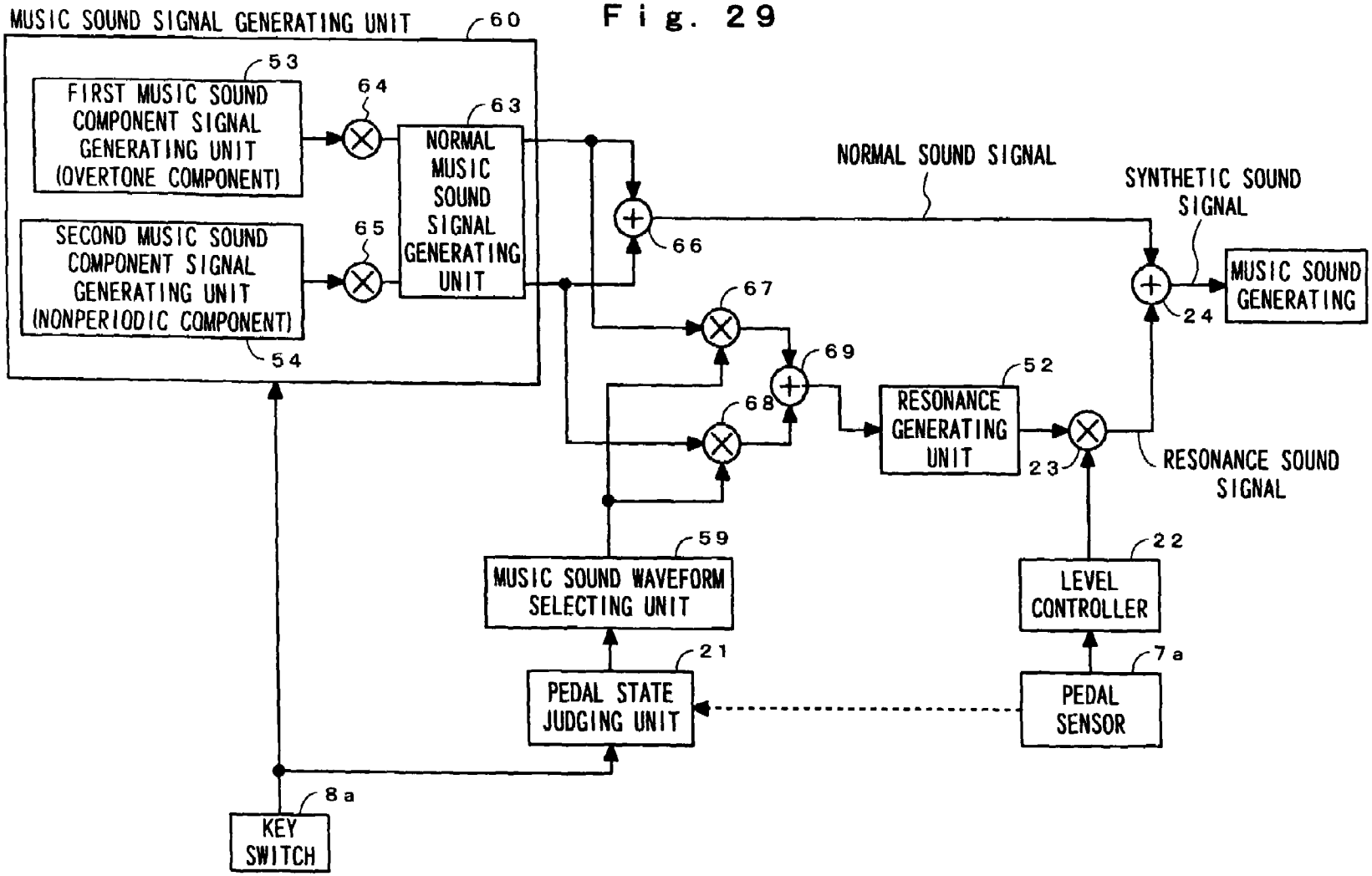
FIG. 29 is a functional block diagram according to a variation of the real time resonance generator.

The construction of FIG. 28 can be varied as follows. FIG. 29 is a block diagram showing main part functions of an electronic piano according to a variation in which a resonance signal is generated in real time, and the same reference numerals as in FIG. 1 and FIG. 28 denote identical or equivalent portions. In this figure, the music sound signal generating unit 60 is provided with a first music sound component signal generating unit 53 and a second music sound component signal generating unit 54, and generates a first music sound signal containing only harmonic overtone components based on the first music sound component signal and generates a second music sound signal containing only nonperiodic components based on the second music sound component signal. These music sound signals are generated by the normal music sound signal generating unit 63 constituted by a single tone generator. The first and second music sound component signals are changed in amplitude ratio by the multipliers 64 and 65 and then synthesized into a normal sound signal by the adder 66 and inputted into the adder 24.

On the other hand, the first and second music sound component signals are inputted into the respective multipliers 67 and 68 for resonance signal generation. The multipliers 67 and 68 control the amplitude ratio of the first music sound component signal and the second music sound component signal according to selection made by the music sound waveform selecting unit 59. When the music sound waveform selecting unit 59 receives an input of the result of judgment of the before-key-pressing operation from the pedal state judging unit 21, it controls both of the first and second music sound component signals to a predetermined amplitude and inputs these into the adder 69. When an after-key-pressing operation is judged, the multiplier coefficient to be supplied to the multiplier 68 is set to zero, and only the first music sound component signal generated from harmonic overtone components is inputted into the adder 69.

The first music sound component signal and the second music sound component signal added by the adder 69 or the first music sound component signal is inputted into the resonance generating unit 52. The resonance generating unit 52 generates a resonance signal and inputs it into the multiplier 23. The multiplier 23 controls the level of the resonance signal according to a pedal stepping on depth and inputs it into the adder 24. In the adder 24, the normal sound signal and the resonance signal are added and outputted as a synthetic music sound signal.

In this second embodiment, the music sound component signal is inputted at a small amplitude into a resonance circuit group of the same pitch name and inputted at a great amplitude into resonance circuits of different pitch names to prevent the output of the resonance circuit group of the same pitch name from becoming remarkably higher than the outputs of other resonance circuit groups, so that well-balanced resonance can be obtained.

Figure 17:
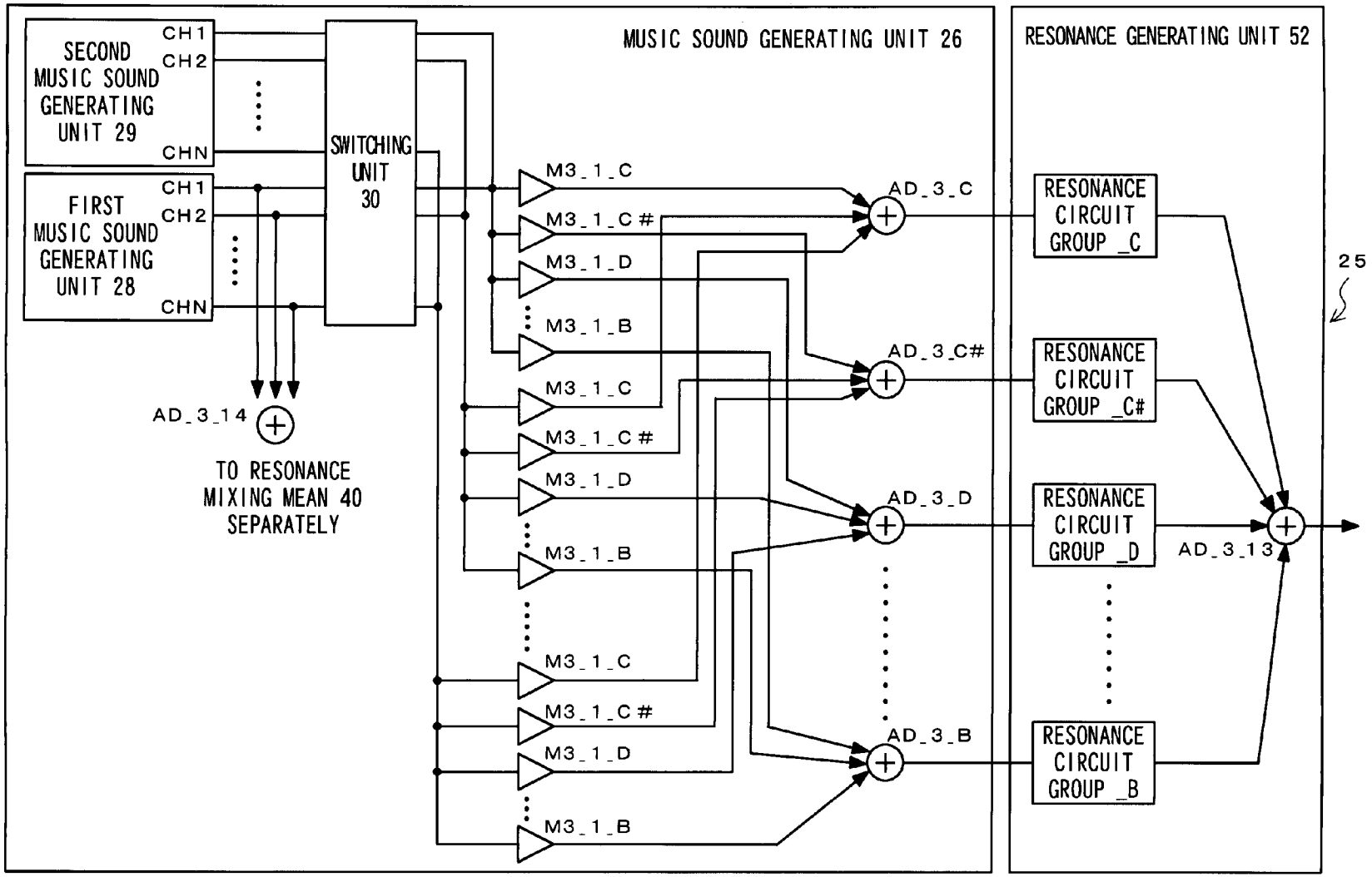
FIG. 17 is a block diagram showing main part functions of a resonance generator according to a second embodiment.

FIG. 17 is a detailed block diagram of the music sound signal generating unit 60 and the resonance generating unit 52. The resonance generator 25 has the music sound generating unit 26 and the resonance generating unit 52. The first music sound generating unit 28 and the second music sound generating unit 29 of the music sound generating unit 26 correspond to the first music sound component signal generating unit 53 and the second music sound component signal generating unit 54 (FIG. 29), and the output sides of these are provided with music sound generating channels CH1 through CHN. The switching unit 30 corresponds to the music sound waveform selecting unit 59 (FIG. 29).

Each resonance circuit of the resonance circuit group of the resonance generating unit 52 has a digital filter equivalent to the resonance waveform generating circuit described in relation to FIG. 6.

Each music sound generating channel is branched into two, and either signal of the branched music sound component signals outputted from the first music sound generating unit 28 is added by the adder AD_3_14 and inputted into a resonance synthesizing unit corresponding to the adder 24, and mixed with a resonance signal to be outputted through the adder AD_3_13 of the resonance generating unit 52.

On the other hand, the music sound generating channels CH1 through CHN are connected, respectively, to multipliers provided as many as the number of pitch names (in this embodiment, the instrument is an electronic piano, so that the pitch names are twelve of C (do), C# (do#), D (re), D# (re#), E (mi), F (fa), F# (fa#), G (sol), G# (sol#), A (la), A# (la#), and B (ti)), and channels of the same pitch name are collectively connected to one of the adders (also corresponding to the respective pitch names, in this embodiment, twelve pitch names from C to B). The outputs of the adders are transmitted to the respective groups of the resonance circuits (in this embodiment, twelve groups from C to B) of the resonance generating unit 52 provided corresponding to each pitch name.

The reason for using this construction is as follows. When the resonance frequency of a resonance circuit and a frequency of a music sound to be inputted into it are close to each other, the amplitude of the output waveform (resonance) therefrom becomes greater. Therefore, the output waveform of the resonance circuit whose resonance frequency is apart from the frequency of the inputted music sound and the output waveform of the resonance circuit whose resonance frequency is very close to the frequency of the inputted music sound are imbalance in volume. Accordingly, the output sound is not as originally desired as resonance but sounds like a stable music sound with the resonance frequency.

Figure 18:
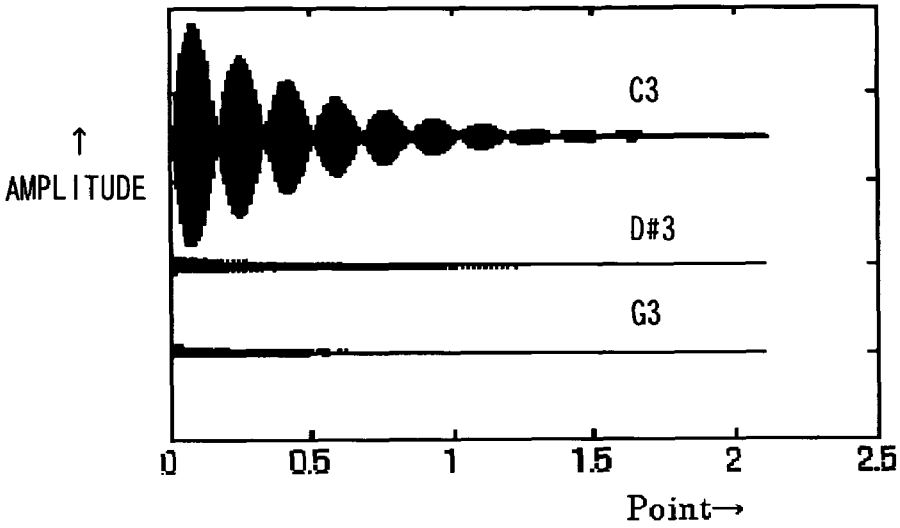
FIG. 18 is a diagram showing waveforms of resonances as output waveforms when waveforms of pitch names C3, D#3, and G3 are inputted into a resonance circuit group C.

For example, FIG. 18 shows output waveforms (resonances) when waveforms of intervals C3, D#3, and G3 are inputted into the resonance circuit group C of FIG. 17. The resonance of the resonance circuit group C is remarkably great at C3. In this state, the sounds of C3 and G3 are excessively great and a resonance sound as in the case where the pedal 7 of a piano is pedaled down cannot be obtained.

Therefore, when a music sound is inputted into a resonance circuit whose resonance frequency is very close to a frequency of the music sound, the amplitude of the music sound must be made smaller than in the case where it is inputted into other resonance circuits.

Figure 19:
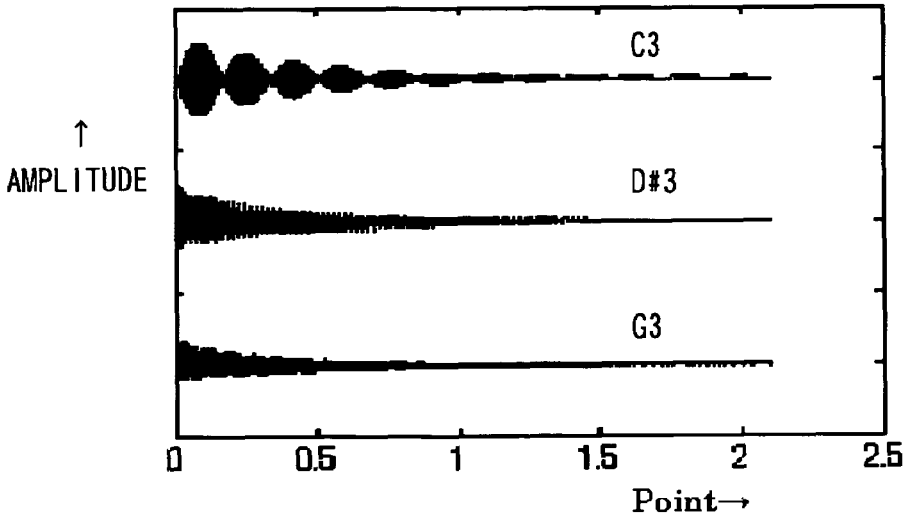
FIG. 19 is a diagram showing resonances when the amplitude of only C3 waveform is made small when waveforms of pitch names C3, D#3 and G3 are inputted into the resonance circuit group C.

According to the example of output waveforms of FIG. 18, when the music sound is inputted into the resonance circuit group C, by making smaller the amplitude of only the waveform of C3, the resonances of the intervals become substantially equal to each other in amplitude as shown in FIG. 19. Thereby, the resonance sound as in the case where the pedal 7 is pedaled down can be obtained.

Namely, originally, the construction after the multipliers of the channels of the music sound generating unit 26 is drawn out for the resonance generating unit 52 side of the rear stage, and when creating resonances in the resonance circuit groups, an amplitude of a music sound which causes volume imbalance of the output waveform of the resonance circuit whose resonance frequency is very close to the frequency of the inputted music sound is made smaller than in the case where it is inputted into other resonance circuits by using a multiplier in which a music sound is inputted whose resonance frequency is very close to the frequency of the inputted music sound among the twelve multipliers from C to B corresponding to the respective pitch names of the music sound generating channels CH1 through CHN.

The music sound generating channels CH1 through CHN of the music sound generating unit 26 are used as many as the number of music sounds to be generated. For example, when only the music sound C1 is generated, the music sound C1 is outputted only from the channel CH1. When the music sounds C1, E1, and Glare generated, C1 is outputted from the channel CH1, E2 is outputted from the channel CH2, and G1 is outputted from the channel CH3.

Twelve of multipliers M3_1_C through M3_1_B corresponding to pitch names consist of one set and are provided as one set for each music sound generating channel in this embodiment. Therefore, the total number of multipliers is N (number of music sound generating channels)×12 (all pitch names).

An output of one channel is inputted into twelve multipliers M3_x_C, M3_x_C# . . . M3_x_B (x indicates a music sound generating channel number, and the final alphabet letter indicates a pitch name corresponding to a resonance circuit) corresponding to pitch names. The amplitude of the music sound to be inputted into the resonance circuits C through B is controlled by the respective multipliers. This amplitude control by the multipliers will be described later.

For example, when a sound is generated from the music sound generating channel CH1, the music sound from the music sound generating channel CH1 is inputted into all twelve multipliers M3_1_C through M3_1_B.

The twelve adders AD_3_C, AD_3_C#, AD_3_D . . . AD_3_B are provided corresponding to pitch names. The multipliers corresponding to pitch names are connected to the adders similarly corresponding to the pitch names. This is for adding outputs of the plurality of multipliers corresponding to the same pitch name and outputting the sum to the corresponding resonance group of the resonance circuits provided corresponding to the pitch names. Namely, outputs of the music sound generating channels whose amplitudes are controlled (through the multipliers) are added for each resonance circuit. For example, the multipliers M3_1_C, M3_2_C . . . M2_N_C are connected to the adder AD_3_C of the same pitch name (C), and the multipliers M3_1_C#, M3_2_C# . . . M3_N_C# are connected to the adder AD_3_C# of the same pitch name (C#).

Furthermore, the resonance circuit groups are provided corresponding to the pitch names (in this embodiment, twelve pitch names of C (do), C# (do#), D (re), D# (re#), E (mi), F (fa), F# (fa#), G (sol), G# (sol#), A (la), A# (la#), and B (ti)) (C, C# . . . B), respectively.

One resonance circuit group consists of resonance circuits corresponding to all harmonic overtones of the corresponding pitch name. For example, the resonance circuit group C consists of resonance circuits corresponding to all harmonic overtones of the music sound C1, all harmonic overtones of C2, all harmonic overtones of C3 . . . all harmonic overtones of C8. Alternatively, the resonance circuit group may consist of resonance circuits corresponding to all harmonic overtones of the music sound C1, all harmonic overtones of C2, all harmonic overtones C3 . . . all harmonic overtones of C6 in the range provided with dampers.

Figure 20:
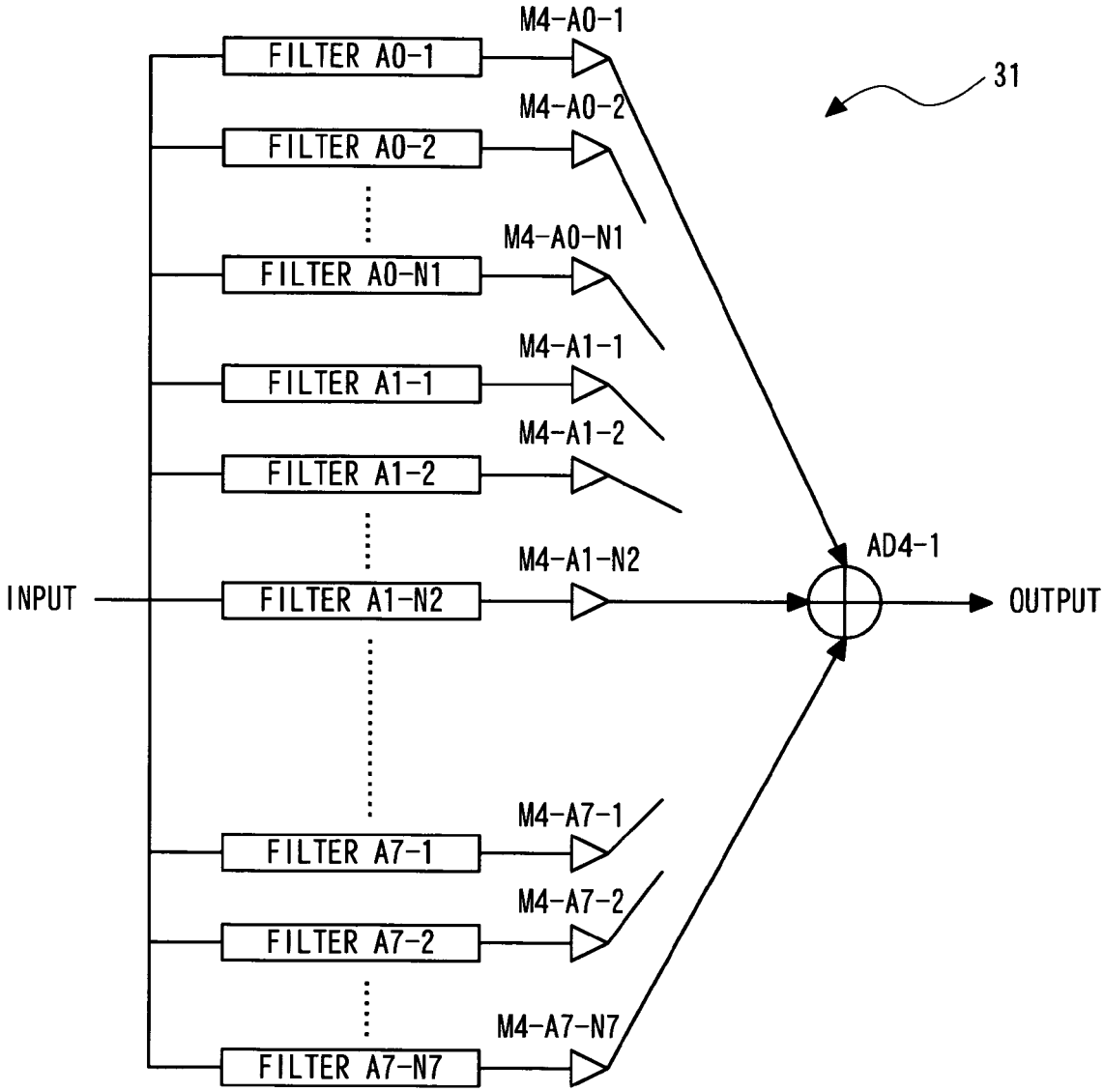
FIG. 20 is a block diagram showing a construction of the resonance circuit group corresponding to a pitch name A included in the resonance generating unit.

For example, as in the resonance generating circuit shown in FIG. 20, one filter and a multiplier M4-A0-1 to be connected to the filter are paired to form a resonance circuit with a resonance frequency corresponding to a frequency of one harmonic overtone of a music sound of one pitch name (key). In this embodiment, the filter A0-1 and the multiplier M4-A0-1 form a resonance circuit with a resonance frequency corresponding to the frequency of the first harmonic overtone of the pitch name A0, and similarly, the filter A0-2 and the multiplier M4-A0-2 form a resonance circuit with a resonance frequency corresponding to the second harmonic overtone of the pitch name A0, and the filter A0-N1 and the multiplier M4-A0-N1 form a resonance circuit with a resonance frequency corresponding to the highest-order harmonic overtone of A0. Similarly, the pairs of the filter A1-1 and the multiplier M4-A1-1, the filter A1-2 and the multiplier M4-A1-2, and the filter A1-N2 and the multiplier M4-A1-N2 form resonance circuits with resonance frequencies corresponding to the first harmonic overtone, the second harmonic overtone, and the highest-order harmonic overtone of the pitch name A1, respectively.

The same applies to the filters A7 and so on. In this embodiment, resonance circuits corresponding to all harmonic overtones of the 8 intervals of A0, A1, A2 . . . A7 are connected in parallel. By arbitrarily setting multiplier coefficients of the multipliers MA-A0-1 through M4-A0-N7 of each resonance circuit, timbre of resonance can be freely set. It is also possible that resonance circuits corresponding to all harmonic overtones of 6 intervals of A0, A1, A2 . . . A5 in the range with dampers are connected in parallel.

Furthermore, by the adder AD4-1 which adds the outputs of all resonance circuits, the outputs of resonances for one music sound are unified.

In FIG. 20, as an input signal, either one of waveform data of a normal sound and waveform data containing only harmonic overtone components obtained by removing nonperiodic components as an impact sound of key pressing from the normal sound is selected according to the timing of turning-on of the pedal sensor 7*a* and the key switch 8*a* similarly to the first embodiment (FIG. 1 and FIG. 6).

Next, the flow of the signal in the above-described construction will be described. First, generation of only a single tone being generated from the music sound generating channel will be described. Herein, it is assumed that the key of the pitch name C1 of the keyboard is pressed. A music sound signal C1 is outputted from the music sound generating channel CH1 of the music sound generating unit 28. The music sound signal C1 is outputted to the adder AD_3_C corresponding to the pitch name C through the multiplier M3_1_C corresponding to the pitch name C. The music sound signal C1 is also outputted to the adder AD_3_C# corresponding to the pitch name C# through the multiplier M3_1_C# corresponding to the pitch name C#.

Similarly, the music sound signal C1 is also inputted into the adders AD_3_D through AD_3_B corresponding to other 10 pitch names D to B through the multipliers M3_1_D through M3_1_B corresponding to the 10 pitch names D to B.

At this time, the inputted music sound signal is C1, so that only the multiplier coefficient of the multiplier M3_1_C is set to be smaller than that of other multipliers M3_1_D through M3_1_B. For other multipliers M3_1_D through M3_1_B, the same multiplier coefficient is set (for example, the multiplier coefficients of other multipliers are set to "1" and only the multiplier coefficient of the multiplier M3_1_C is set to "0.1"). Therefore, only the amplitude of the music sound that passed through the multiplier M3_1_C becomes smaller.

Each adder outputs the inputted music sound signal C1 that was controlled in amplitude to a corresponding resonance circuit group corresponding to the same pitch name as that of the adder. Namely, the adders AD_3_C through AD_3_B output a music sound signal C1 to the resonance circuit groups C through D, respectively.

Next, generation of a plurality of sounds from the music sound generating channels will be described. Herein, it is assumed that the key of the pitch name C1 and the key of the pitch name E1 of the keyboard 8 are pressed. A music sound signal C1 is outputted from the channel CH1 and a music sound signal E1 is outputted from the channel CH2 of the music sound generating unit 28.

The music sound signal C1 is outputted to the adder AD_3_C corresponding to the pitch name C through the multiplier M3_1_C corresponding to the pitch name C. Also, the music sound signal C1 is outputted to the adder AD_3_C# corresponding to the pitch name C# through the multiplier M3_1_C# corresponding to the pitch name C#. Similarly, the music sound signal C1 is inputted into the adders AD_3_D through AD_3_B corresponding to other 10 pitch names D through B through multipliers M3_1_D through M3_1_B corresponding to the 10 pitch names D through B.

The inputted music sound signal is C1, so that only the multiplier coefficient of the multiplier M3_1_C is set to be smaller than that of other multipliers M3_1_D through M3_1_B. In other multipliers M3_1_D through M3_1_B, the same multiplier coefficient is set. Therefore, only the amplitude of the music sound that passed through the multiplier M3_1_C becomes smaller.

Similarly, the music sound signal E1 is outputted to the adder AD_3_C corresponding to the pitch name C through the multiplier M3_2_C corresponding to the pitch name C. Also, the music sound signal E1 is outputted to the adder AD_3_C# corresponding to the pitch name C# through the multiplier M3_2_D# corresponding to the pitch name C#. Similarly, the music sound signal E1 is inputted into the adders AD_3_D through AD_3_B corresponding to other 10 pitch names D through B through the multipliers M3_1_D through M3_1_B corresponding to the 10 pitch names D through B.

The inputted music sound signal is E1, so that only the multiplier coefficient of the multiplier M3_2_E is set to be smaller than that of other multipliers M3_2_C through M3_2_D# and M3_2_F through M3_2_B. In other multipliers M3_2_C through M3_2_D# and M3_2_F through M3_2_B, the same coefficient is set. Therefore, only the amplitude of the music sound that passed through the multiplier M3_2_E becomes smaller.

The adders AD_3_C through AD_3_B add the music sound signal C1 whose amplitude was controlled (through the multiplier) and the music sound signal E1 whose amplitude was controlled and output the sum to the corresponding resonance circuit groups C through B.

When the frequency of the harmonic overtone included in the music sound to be inputted into the resonance circuit and the resonance frequency of the resonance circuit are very close to each other, the resonance to be outputted from this resonance circuit may become much greater than in the case where these frequencies are different from each other, and the output waveform of the resonance circuit whose resonance frequency is apart from the frequency of the inputted music sound and the output waveform of the resonance circuit whose resonance frequency is very close to the frequency of the inputted music sound are in imbalance in volume, so that the output sound is not the resonance as originally desired.

However, in this embodiment, when the music sound signal is inputted into a resonance circuit whose resonance frequency is very close to the frequency of the music sound signal, the amplitude of the music sound signal is made smaller than in the case where it is inputted into other resonance circuits. Therefore, when the music sound signal is inputted into the resonance circuit group C, only the waveform of C3 is made smaller. Therefore, the resultant resonances are substantially the same in amplitude at all intervals. Accordingly, in the electronic piano of this embodiment, the resonance sound produced when the damper pedal of an acoustic piano is pedaled down can be obtained.

Figure 21:
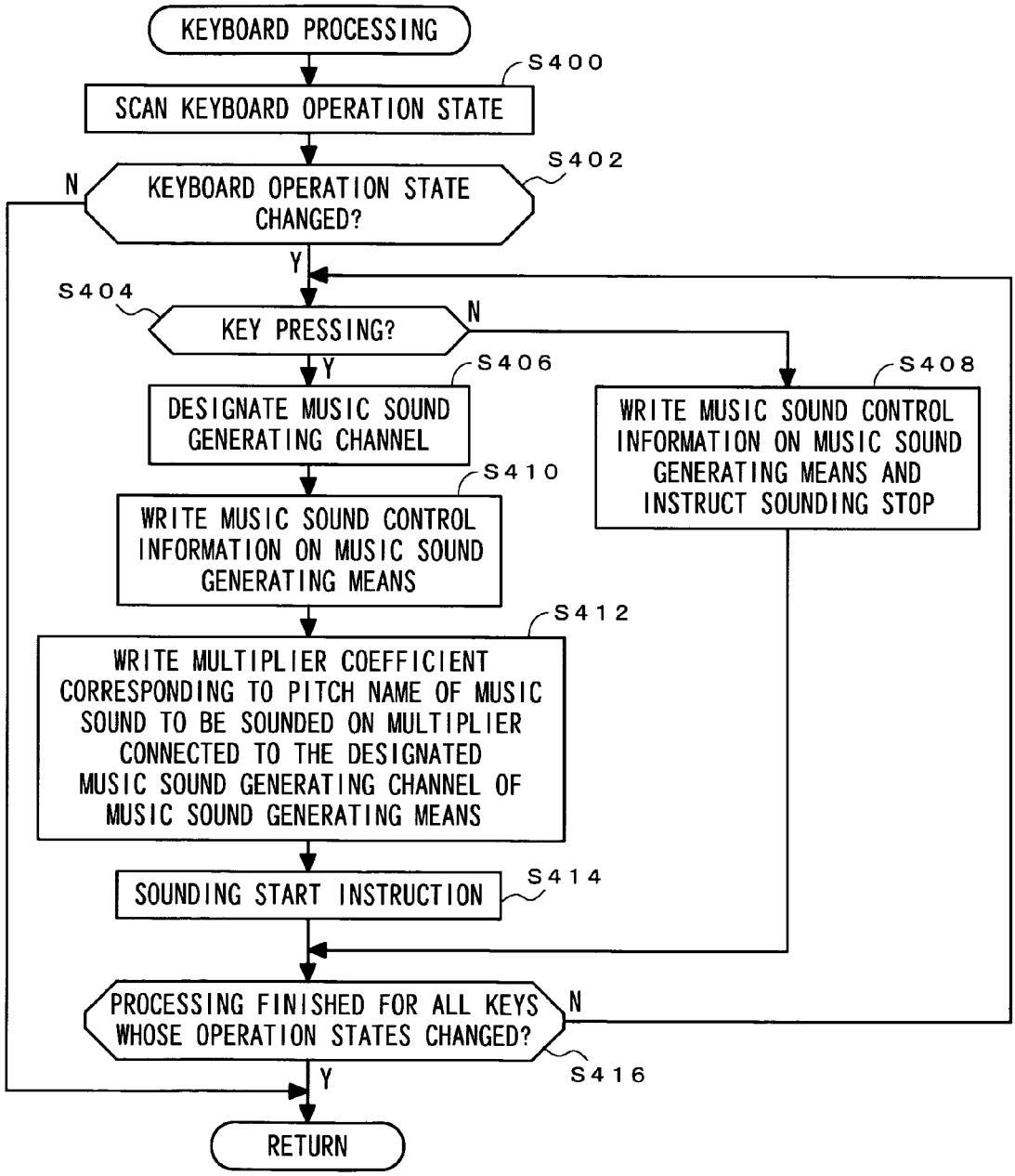
FIG. 21 is a flowchart showing keyboard processing in the second embodiment.

An operation processing flow of the electronic piano of the second embodiment is described. However, the main processing flow and the pedal processing flow are the same as that of the first embodiment, so that description of these is omitted. FIG. 21 is a flowchart showing keyboard processing in the electronic piano of the second embodiment.

In FIG. 21, at Step S400, an operation state of the keyboard 8 is scanned. At Step S402, it is checked whether the operation state of the keyboard 8 has been changed. When the operation state of the keyboard 8 is not changed, the keyboard processing is ended and the process transfers to the pedal processing of the main flow. When the operation state of the keyboard 8 is changed, the process advances to Step S404 and it is checked whether the changed operation is key pressing.

When it is judged at Step S404 that the operation is not key pressing, the process advances to Step S408, and music sound control information is written on the music sound generating unit 26 and an instruction of sounding stop is outputted, and the process transfers to the next Step S416. When the operation is judged as key pressing, the process advances to Step S406 and a music sound generating channel is designated. At the subsequent Step S410, the music sound control information is written on the music sound generating unit 26.

At Step S412, a multiplier coefficient corresponding to a pitch name to be sounded is written on a multiplier connected to the designated music sound generating channel of the music sound generating unit 26. Thereafter, at Step S414, a sounding start instruction is outputted.

At Step S416, it is checked whether the processing has been completed for all keys whose operation states were changed.

When the processing is not completed for all keys whose operation states were changed, the process returns from Step S416 to Step S404. On the other hand, when it is judged that the processing has been completed for all keys whose operation states were changed, the keyboard processing is ended and the process transfers to pedal processing of the main flow.

Also in this embodiment, resonance is obtained by generating a music sound by the first music sound generating unit 28 and by inputting the music sound signal into the resonance generating unit 52 including a plurality (twelve in the case of a general instrument such as a piano) of resonance circuit groups C through B corresponding to the pitch names (C, C#, D . . . B in the case of a general instrument such as a piano) of a music sound to be outputted from the first music sound generating unit 28 or the second music sound generating unit 29.

In this embodiment, the generated music sound signal is inputted at a small amplitude into a resonance circuit group of the same pitch name (inputted into a resonance circuit whose resonance frequency is very close to the frequency of the music sound signal) (in the above-described example, when the signal is inputted into the resonance circuit group C,) only the waveform of C3 is lowered in amplitude, whereby resonances of all intervals are substantially equal in amplitude to each other as shown in FIG. 19), and inputted at a great amplitude into a resonance circuit of a different pitch name, so that the output of the resonance circuit group of the same pitch name is prevented from becoming remarkably higher than the outputs of other resonance circuit groups, so that well-balanced resonance is obtained. Thereby, a sound as in the case where the pedal 7 is operated can be obtained.

Also in this embodiment, as described in FIG. 12, for harmonic overtones whose frequencies are substantially equal to each other, resonance circuits are not individually provided, but one resonance circuit whose resonance frequency is a frequency of one harmonic overtone or an average frequency of the harmonic overtone frequencies may be provided.

In this embodiment, as described in relation to FIG. 15, it is also possible that an output of the resonance generating unit 52 is multiplied as predetermined and added to an inputted music sound and fed back to and inputted again into this resonance generating unit 52, or as described in relation to FIG. 17, it is also possible that the construction of FIG. 15 is employed and in a feedback path thereof, a delay device D11-1 for delaying an output of the resonance generating unit 52 by a predetermined time and a filter Filt11-1 for changing amplitude-frequency characteristics of the output of the resonance generating unit 27 may be provided.

Next, a third embodiment of the invention will be described. In the third embodiment, resonance signals created by the resonance generating units of the second embodiment are stored in advance in resonance waveform storage means according to a before-key-pressing operation and an after-key-pressing operation. Then, in response to playing (operation information of operator), its waveform is readout and a resonance sound played while the pedal 7 is pedaled down is reproduced.

Figure 22:
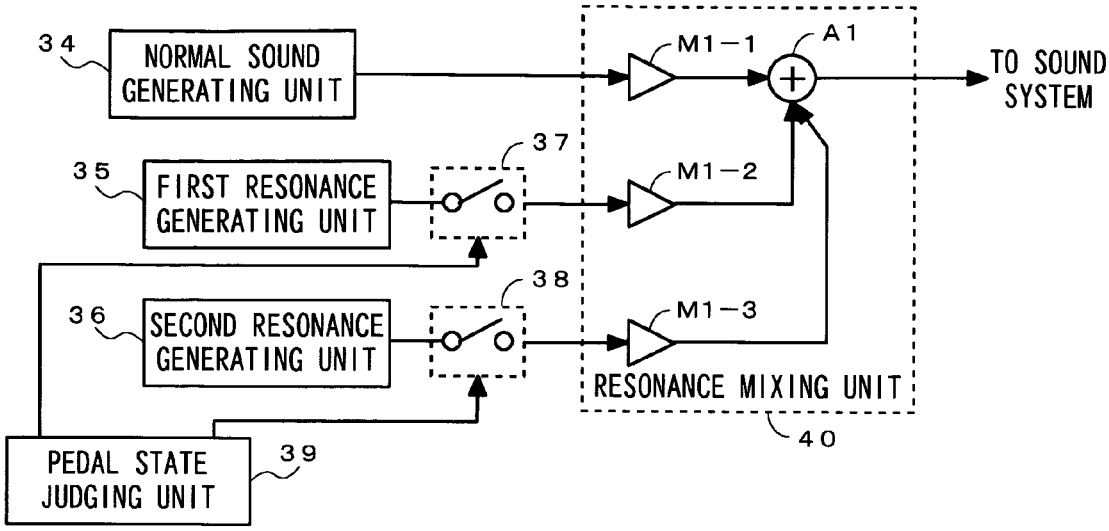
FIG. 22 is a block diagram showing main part functions of a resonance generator according to a third embodiment.

FIG. 22 is a block diagram showing main part functions of a resonance generator according to the third embodiment. The resonance generator is provided with a normal sound generating unit 34, a first resonance generating unit 35, and a second resonance generating unit 36. Individually, the normal sound generating unit 34 generates a normal sound signal, the first resonance generating unit 35 generates a first resonance signal, and the second resonance generating unit 36 generates a second resonance signal, and these are multiplied by multiplier coefficients in the respective multipliers M1-1, M1-2, and M1-3 corresponding to the music sound and then added by the adder A1 and outputted to the sound system 13. Namely, the multipliers M1-1, M1-2, and M1-3 multiply the amplitudes of the inputted music sounds by predetermined multiplier coefficients, and the adder A1 adds the resonances multiplied as predetermined and the music sound synthesizes these.

The first resonance signal is inputted into the multiplier M1-2 via the switch 37 and the second resonance signal is inputted into the multiplier M1-3 via the switch 38 when these switches are on respectively. The switches 37 and 38 are turned on in response to a judgment signal based on the states of the key switch 8*a* and the pedal sensor 7*a* judged by the pedal state judging unit 39. When the pedal state judging unit 39 detects a before-key-pressing operation, it turns the switch 37 on, and when it detects an after-key-pressing operation, it turns the switch 38 on. The switches 37 and 38 are turned off when the pedal sensor 7*a* is turned off. Namely, the pedal state judging unit 39 operates similarly to the pedal state judging unit 21 of FIG. 1.

The first resonance signal is a music sound signal of resonance based on a normal sound, and is a music sound signal of resonance based on music sound information (waveform data) of only harmonic overtone components obtained by removing nonperiodic components as an impact sound of key pressing from the normal sound.

The multipliers M1-1, M1-2, and M1-3 and the adder A1 form a resonance mixing unit 40. The resonance mixing unit 37 can be constituted by a digital signal processor. The first resonance generating unit 35 and the second resonance generating unit 36 read out waveforms from waveform memories storing resonance waveforms created by a resonance arithmetic device 41 that will be described later.

The construction of the normal sound generating unit 34 is the same as that in other embodiments described above, so that description thereof is omitted herein.

The first resonance generating unit 35 and the second resonance generating unit 36 are constituted by a music sound generator using a reading out method and a waveform memory storing resonance waveforms. The normal sound generating unit 34, the first resonance generating unit 35, and the second resonance generating unit 36 may be constituted by the same music sound generator, or may individually have a music sound generator.

The multiplier coefficients of the multipliers M1-1, M1-2, and M1-3 are determined according to the pedaling down depth of the pedal 7 of the music sound control information.

As described above, the first and second resonance generating units 35 and 36 are constituted by a sound source using a reading out method and a waveform memory storing resonance waveforms. The electronic piano main body does not create resonance waveforms, but resonance waveforms are created in advance by a resonance arithmetic device separate from the electronic piano and stored in the waveform memories as resonance waveform storage means and used.

The resonance arithmetic device is realized by a signal processor separate from the electronic piano and a program describing signal processing procedures of the signal processor. The signal processor can be constructed in the same manner as described in relation to FIG. 20.

In FIG. 22, an output signal (waveform data) when a music sound signal of a normal sound is an input signal is stored in the waveform memory of the first resonance generating unit 35. On the other hand, in response to, as an input signal, waveform data of only harmonic overtone components obtained by removing nonperiodic components as an impact sound of key pressing from the normal sound, waveform data created in the signal processor of FIG. 20 is stored in the waveform memory of the second resonance generating unit 36 which generates a second resonance. The waveform data is created by the signal processor of FIG. 20 for each pitch name.

The resonance arithmetic device to be used in this third embodiment is necessary for storing the resonance waveforms in the resonance waveform storage means, and after the waveforms are stored, the electronic instrument does not need to use the resonance arithmetic device except for storing of a new resonance.

The multiplier coefficients of the multipliers M4-A0-1 through M4-M7-N4 in FIG. 20 are changed according to a music sound.

At this time, the amplitude of an output waveform of a resonance circuit whose resonance frequency is equal to the frequency of a harmonic overtone included in the music sound to be inputted is made smaller than that of the output waveforms of other resonance circuits. Namely, the filters are resonance circuits having resonance frequencies substantially equal to the frequencies of harmonic overtones of the music sound to be inputted. Therefore, when a harmonic overtone with a frequency equal to the resonance frequency is inputted, the output of the resonance circuit becomes greater in amplitude than other resonance circuit outputs.

The amplitude of the resonance circuit with a resonance frequency equal to the frequency of a harmonic overtone included in the music sound to be inputted must be prevented from becoming greater than that of other resonance circuits.

Therefore, the multiplier coefficient of the multiplier of the resonance circuit with a resonance frequency equal to the frequency of a harmonic overtone included in the music sound to be inputted must be set smaller than the multiplier coefficients of multipliers of other resonance circuits.

Figure 23:
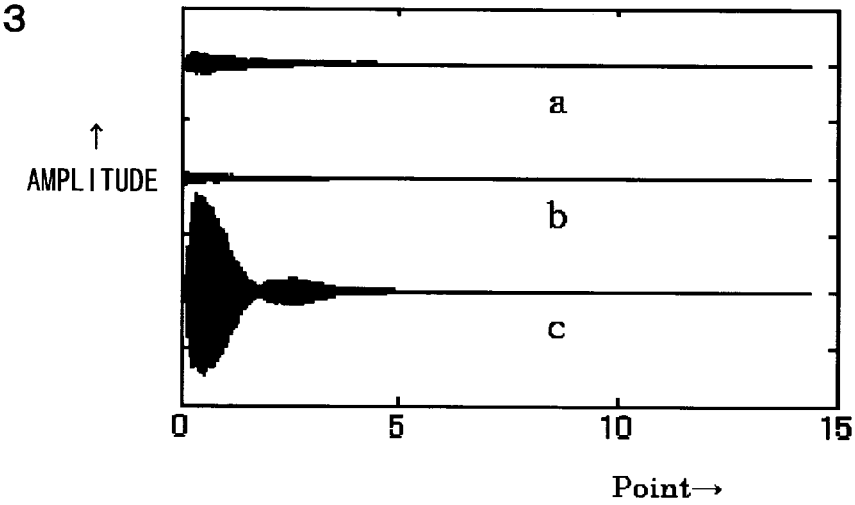
FIG. 23 is a graph showing sums of outputs obtained when a music sound of F6 is inputted into a plurality of resonance circuits with resonance frequencies of harmonic overtones included in C6, a plurality of resonance circuits with resonance frequencies of harmonic overtones included in D#6, and a plurality of resonance circuits with resonance frequencies of harmonic overtones included in F6.

For example, the waveform a of FIG. 23 is a sum of outputs of a plurality of resonance circuits with resonance frequencies of harmonic overtones included in C6 when a music sound of F6 is inputted into the resonance circuits. Similarly, the waveform b is a sum of outputs of a plurality of resonance circuits with resonance frequencies of harmonic overtones included in D#6 when a music sound of F6 is inputted into the resonance circuits. Similarly, the waveform c is a sum of outputs of a plurality of resonance circuits with resonance frequencies of harmonic overtones included in F6 when a music sound of F6 is inputted into the resonance circuits.

The levels of the resonance circuits at this time (multiplier coefficients of multipliers immediately after the filters FA0-1 through F7-N1) are all "1". In comparison with the waveforms a and b, the amplitude of the waveform c is much larger.

Therefore, even when these resonances are added, the obtained sound sounds like the music sound of F6 different from the resonance.

Figure 24:
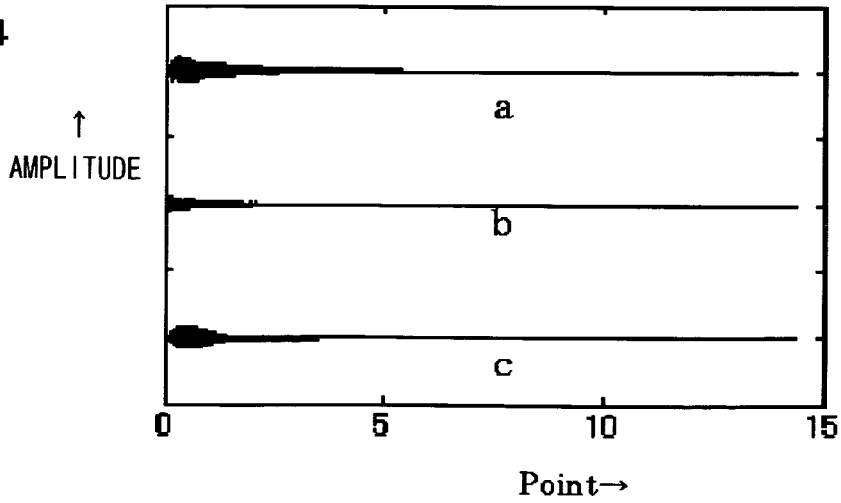
FIG. 24 is a graph showing sums of outputs when the output levels of the resonance circuits of C6 and the resonance circuits of D#6 are set to 1 and the output levels of the resonance circuits of F6 are set to 0.1.

FIG. 24 shows output waveforms when the output levels of the resonance circuits of C6 and the resonance circuits of D#6 are "1" and the output level of the resonance circuits of F6 (the multipliers M3-F6-1 through M3-F6-N69 of FIG. 20) is "0.1". By setting these output levels, the amplitude of the resonance circuit output of F6 also becomes substantially the same as that of other resonance circuit outputs.

By adding these resonances, the resonance sound of playing while the pedal 7 is pedaled down can be obtained (for the sake of easy explanation, the number of resonances is 3, however, in actuality, outputs of all resonance circuits are added).

In the third embodiment, as described above, the resonance circuits of FIG. 22 are used for creating resonances to be stored in the first resonance generating unit 36 and the second resonance generating unit 36, respectively.

The resonance waveforms calculated by the resonance arithmetic device constructed as described above are stored in the resonating waveform memories, so that the resonance arithmetic device is used only in the manufacturing process of the electronic piano and is not included in the electronic piano, normally. However, it may be included in the electronic piano to create and store new resonances in the waveform memories of the first resonance generating unit 35 and the second resonance generating unit 36.

The flow of playing the electronic piano according to this embodiment in which resonances created by the resonance arithmetic device are stored in the waveform memories will be described.

First, when the keyboard 8 is pressed, music sound control information including the pitch corresponding to the key and intensity (velocity) corresponding to the key-pressing speed are created and transmitted to the normal sound generating unit 34. When a plurality of keys are pressed, music sound control information including a plurality of pitches and intensities corresponding to the keys are created and transmitted to the normal sound generating unit 34.

The normal sound generating unit 34 reads a music sound corresponding to the music sound information and transmits it to the resonance mixing unit 40. When a plurality of music sounds are generated, these music sounds are added and transmitted to the resonance mixing unit 40. For example, when the keys of C3 and G3 are strongly operated, a music sound waveform corresponding to the strong striking of C3 and a music sound waveform corresponding to the strong striking of G3 are readout from the waveform memories and a waveform obtained by adding these waveforms is transmitted as a music sound to the resonance mixing unit 40.

The key information is also transmitted to the first resonance generating unit 35 and the second resonance generating unit 36 simultaneously with detection of key pressing. The first resonance generating unit 35 reads out resonance waveforms corresponding to the pitches and operating strengths of the operated keys from the waveform memory storing resonance waveforms, and adds these. Similarly, the second resonance generating unit 36 also reads out resonance waveforms corresponding to the pitches and operating strengths of the operated keys from the waveform memory storing resonance waveforms, and adds these. Among the added waveform data, an output from the resonance generating unit connected to either one being turned on according to the result of judgment made by the pedal state judging unit 39 of the switches 37 and 38 is inputted into the resonance mixing unit 40.

For example, when the keys of C3 and G3 are strongly operated, a resonance waveform corresponding to the strong striking on C3 and a resonance waveform corresponding to the strong striking on G3 are readout from the waveform memories and a waveform obtained by adding these waveforms is transmitted as a music sound to the resonance mixing means 40.

In this case, even if the pedal 7 is not pedaled down, the resonance waveforms are readout. In both of these normal sound generation and resonance generation, instead of selecting a waveform according to the key operating strength, the amplitude when reading out may be changed. Alternatively, the envelope may be changed.

The resonance mixing unit 40 adds resonances multiplied as predetermined by the multipliers M1-2 and M1-3 and the music sound multiplied as predetermined by the multiplier M1-1 outputs the sum to the sound system. At this time, the multiplier coefficients of the multipliers M1-2 and M1-3 are changed by detecting the pedaling down depth on the pedal 7 each time the pedal 7 is pedaled down. The multiplier coefficients become higher as the pedaling down depth becomes larger, and the multiplier coefficients become smaller as the pedaling down depth becomes smaller. (Resonances are read out regardless of the pedaling down of the pedal 7. The multipliers which change in accordance with the pedaling down of the pedal 7 are only the multipliers M1-2 and M1-3 among the multipliers M1-1 through M1-3 of the resonance mixing unit 40. When the pedal 7 is not pedaled down, the multiplier coefficients of the multipliers M1-2 and M1-3 are "0," so that the amplitude of resonance becomes "0," so that the resonance is not generated apparently.)

It is also possible that the multiplier coefficient is "0" until a predetermined pedaling down depth from the zero stepping on depth, and takes a constant value when the stepping on depth exceeds the predetermined depth.

Herein, an operation processing flow of the electronic piano in this embodiment will be described. The main processing flow is the same as in FIG. 3 and the pedal processing flow is the same as in FIG. 5, so that description of these will be omitted.

Figure 25:
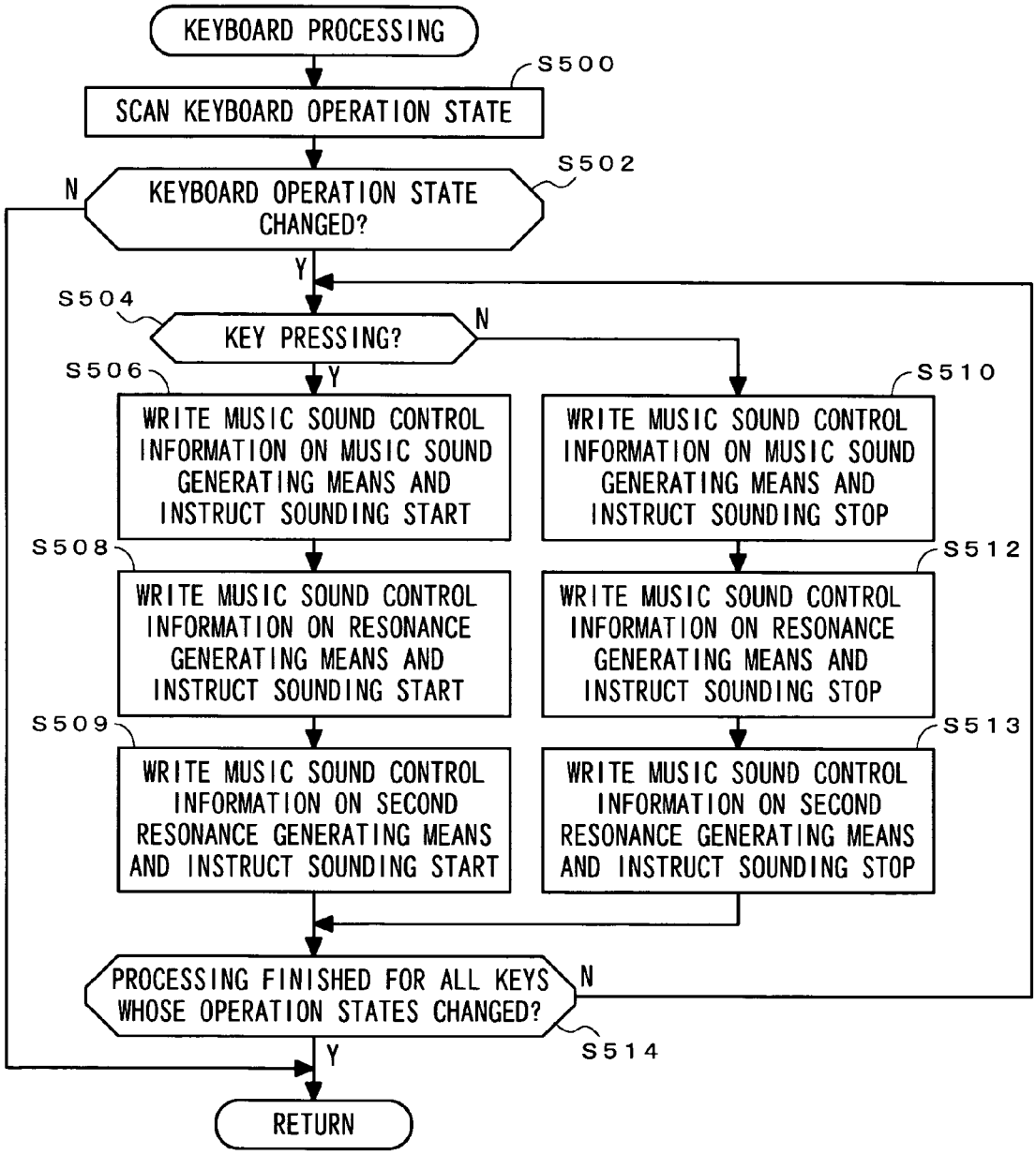
FIG. 25 is a flowchart showing keyboard processing according to a third embodiment.

FIG. 25 is a keyboard processing flowchart of the electronic piano according to the third embodiment. At Step S500 of FIG. 25, the operation state of the keyboard 8 is scanned. At Step S502, it is judged whether the operation state of the keyboard 8 has been changed. When it is judged at Step S502 that the operation state of the keyboard 8 has not been changed, the keyboard processing is ended and the process transfers to the pedal processing of the main flow.

On the other hand, when it is judged at Step S502 that the operation state of the keyboard 8 has been changed, the process advances to Step S504 and it is judged whether the changed operation is key pressing.

When it is judged as key pressing, the process advances to Step S506 and music sound control information is written on the normal sound generating unit 34 and a sounding start instruction is outputted. Furthermore, at Step S508, music sound control information is written on the first resonance generating unit 35, and a sounding start instruction is outputted. At Step S509, the music sound control information is written on the second resonance generating unit 36 and a sounding start instruction is outputted.

When the operation is judged as not key pressing, the process advances to Step S510 and music sound control information is written on the normal sound generating unit 34, and a sounding stop instruction is outputted. At Step S512, the music sound control information is written on the first resonance generating unit 35 and a sounding stop instruction is outputted. At Step S513, the music sound control information is written on the second resonance generating unit 36 and a sounding stop instruction is outputted.

At Step S514, it is checked whether the processing has been completed for all keys whose operation states were changed. When the processing is not completed for all keys whose operation states were changed, the answer of Step S514 is negative and the process returns to Step S504. When the processing was completed for all keys whose operation states were changed, the answer of Step S514 is affirmative and the keyboard processing is ended and the process transfers to the pedal processing of the main flow.

In this embodiment, a music sound is generated by the normal sound generating unit 34 which received music sound control information, that is, key information, and resonance is generated from either of the first and second resonance generating units 35 and 36 which received the music sound control information.

Concerning this resonance, resonance waveforms corresponding to a music sound which is planned to be sounded are created for a before-key-pressing operation and an after-key-pressing operation of the pedal 7 by the resonance arithmetic device and stored in the waveform memories in advance. The waveform memories are installed in the electronic piano corresponding to the first resonance generating unit 35 and the second resonance generating unit 36 at the production process thereof.

The resonance arithmetic device may be installed in the electronic piano. In this case, it becomes possible to create new resonances in the electronic piano.

Also in the third embodiment, as described in FIG. 15, outputs of the first resonance generating unit 35 and the second resonance generating unit 35 may be multiplied as predetermined and added to the inputted music sound, and fed back and inputted again to the respective resonance generating units, or as described in FIG. 16, the construction shown in FIG. 15 may be employed and in the feedback path thereof, the delay device D11-1 for delaying outputs of the first resonance generating unit 35 and the second resonance generating unit 36 by a predetermined time and the filter Flt11-1 for changing amplitude-frequency characteristics of outputs of the first resonance generating unit 35 and the second resonance generating unit 36 may be provided.

Next, a variation of the above-described embodiments will be described. In the above-described embodiments, either one of resonances in the cases of the after-key-pressing operation and before-key-pressing operation of the pedal 7 is selected according to on timings of the pedal 7 and each key on the keyboard 8. The resonance generating method involving this selection is effective especially for a mid-high range of a piano in which an impact sound of key pressing is intensive.

In the low-range of the keyboard of an acoustic piano, an impact sound of key pressing is smaller than in the mid-high range, so that the impact sound is not conspicuous in this range, and resonance caused by the impact sound of key pressing is also small. Therefore, resonance to be generated must not be made different between the before-key-pressing operation and the after-key-pressing operation in the low-range. Namely, in the low-range, waveform data for a before-key-pressing operation can be commonly used as the waveform data to be inputted into the resonance circuits for generating resonance in response to an after-key-pressing operation. Thereby, the capacity of the waveform memory can be saved.

Waveform data for resonance generation to be stored in the waveform memories can be commonly used for a before-key-pressing operation and an after-key-pressing operation. For example, a waveform memory is shared by the first resonance generating unit 35 and the second resonance generating unit 36 of FIG. 22. Namely, in this shared waveform memory, waveform data of resonance including normal resonances, that is, an impact sound of key pressing and resonances caused by this impact sound is stored. When the pedal 7 is pedaled down before key pressing, the waveform data is readout without change to generate resonance. On the other hand, when the pedal 7 is pedaled down after key pressing, this waveform data is readout from the middle of the data to generate resonance.

Figure 26:
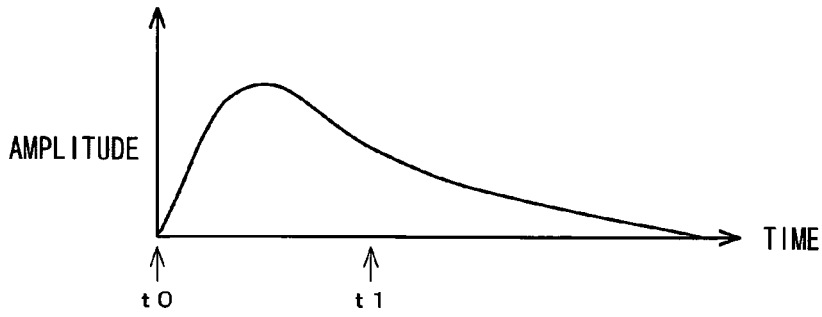
FIG. 26 is a diagram of an example of waveform data according to a variation.

FIG. 26 is a diagram showing an example of waveform data of a variation. The waveform data rises by resonating with a direct sound of key pressing and gradually damps. After time elapses from the time t0 of key pressing, when the pedal 7 is pedaled down at, for example, the time t1, from the time t1, reading out of the waveform data whose amplitude has become smaller is started to generate resonance.

The head of the waveform data of resonance includes resonances of both of harmonic overtone components and impact sound components, however, the resonance of impact sound components damps more quickly than the harmonic overtone components, so that the resonance after this damping is of only the harmonic overtone components. Therefore, in the case of an after-key-pressing operation, reading out is started at the time of damping of the impact sound components, whereby resonance of only harmonic overtone components can be generated.

Therefore, if the time (t1−t0) of FIG. 26 is equal to or more than a predetermined damping time of the impact sound, resonance is generated in response to operation of the pedal 7. If the time (t1−t0) is within the predetermined damping time of the impact sound, after the time delayed from the pedaling down of the pedal 7, resonance is generated.

When waveform data reading out is started, waveform data with a great amplitude is suddenly readout and discontinuous points are read out, and this causes noise. Therefore, to prevent this noise, the readout waveform data is provided with envelope which gently rises. Thereby, not only can noise be prevented but also natural rise of resonance can be reproduced.

Thereby, as resonances to be stored in the waveform memory, only waveform data of normal resonances are stored, so that the capacity of the waveform memory can be saved.

A variation of the above-described embodiment will be described next. It is known that when a damper pedal of a grand piano is operated, the level of a normal sound is lowered. It is considered that this is caused by energy dispersion due to resonance. Therefore, when the pedal 7 is pedaled down, the level of a normal sound is lowered and a music sound when the damper pedal of a grand piano is operated is imitated.

Figure 27:
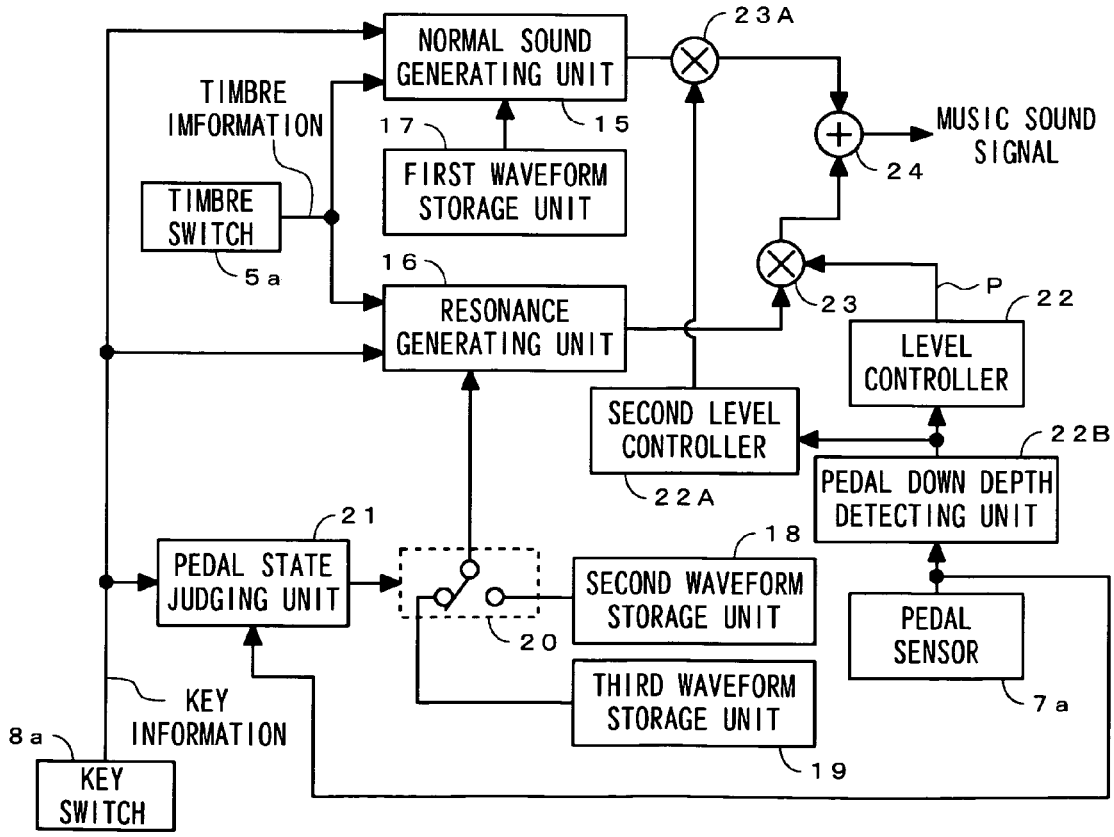
FIG. 27 is a functional block diagram of a resonance generator according to a variation.

FIG. 27 is a functional block diagram of a resonance generator according to a variation, and the same reference numerals as in FIG. 1 show identical or equivalent portions. In this resonance generator, two level controllers (first level controller 22 and second level controller 22A) and a pedaled down depth detecting unit 22B are provided.

The second level control unit 22A supplies a multiplier coefficient to the second multiplier 23A provided between the normal sound generating unit 15 and the adder 24.

The level controller 22 supplies a multiplier coefficient P1 to the multiplier 23 according to a pedaling down depth of the pedal 7, that is, the level of an output of the pedal sensor 7*a*. The multiplier coefficient P1 is set to a great value when the output of the pedal sensor 7*a* is high, and set to a small value when the output of the pedal sensor 7*a* is small.

On the other hand, according to the pedaling down depth of the pedal 7, that is, the level of the output of the pedal sensor 7*a*, the second level controller 22A outputs a small multiplier coefficient P2 when the output of the pedal sensor 7*a* is large, and outputs a great multiplier coefficient P2 when the output of the pedal sensor 7*a* is small.

The multiplier coefficient P1 is changed in the range of "0" to "1.0", however, the multiplier coefficient P2 is changed in the range of "0.9" to "1.0". This is because a normal sound never significantly damps.

The above-described embodiments show an electronic piano as an example of an electronic instrument to which the resonance generator is applied, however, without limiting to the electronic piano, the invention is also applicable with the same construction to other instruments without deviating from the spirit of the invention.

In addition to the construction realizing sound production of resonance of an instrument when it is played simultaneously with generation of a music sound, the resonance generator of this invention can also be applied, instead of an instrument, to generation of resonance of an arbitrary sound or air vibration generated in an acoustic effect room in which a specific acoustic effect is obtained.

What is claimed is:

1. A resonance generator comprising:

normal sound generating means for generating a normal sound in response to a sounding instruction;

first resonance generating means for generating first resonance;

second resonance generating means for generating second resonance;

switching means for selecting the first resonance generating means when a damper operator is operated when the sounding instruction is inputted, and selecting the second resonance generating means when the damper operator is not operated when the sounding instruction is inputted;

level control means for controlling levels of the first resonance and the second resonance according to an operation depth of the damper operator; and resonance mixing means for adding the normal sound and either resonance selected of the first resonance or the second resonance by the switching means, wherein the first resonance is resonance when the damper operator is operated before inputting of the sounding instruction, and the second resonance is resonance when the damper operator is operated after inputting of the sounding instruction.

2. The resonance generator according to claim 1, wherein the first resonance generating means and the second resonance generating means comprise waveform memories storing waveform data and sound source means for generating the first resonance and the second resonance, respectively, based on waveform data readout from the waveform memories.

3. The resonance generator according to claim 2, wherein the waveform memories store waveform data of the first resonance generated from nonperiodic components and harmonic overtone components of a normal sound, and waveform data of the second resonance generated from only harmonic overtone components by removing the non-periodic components.

4. The resonance generator according to claim 3, wherein reading out of the waveform data is started from the middle of the waveform data of the first resonance and used as the waveform data of the second resonance.

5. The resonance generator according to claim 2, wherein common data is used in a predetermined low-range as the waveform data of the first resonance and the waveform data of the second resonance.

6. The resonance generator according to claim 2, wherein the waveform data of the first resonance and the waveform data of the second resonance are waveform data obtained by inputting music sounds into circuit groups consisting of a plurality of resonance circuits connected in parallel corresponding to harmonic overtones of music sounds that can be generated, and are stored in advance in the waveform memories of the first resonance generating means and the second resonance generating means.

7. The resonance generator according to claim 6, wherein the resonance circuit comprises a digital filter, and its impulse response is an imitation of an oscillatory waveform of a harmonic overtone according to a single-degree-of-freedom viscous damping system model, and a filter coefficient to be used in the digital filter is determined by:

calculating a coefficient of viscosity and a coefficient of rigidity which become coefficients of a dynamic equation of the model by providing a mass, a damped natural frequency, and a damping rate as model parameters for determining the behavior of the single-degree-of-freedom viscous damping model;

calculating a filter coefficient of z-representation by Laplace-transforming the dynamic equation of the model to obtain a transfer function equation of s-representation and assigning the calculated coefficient of viscosity, coefficient of rigidity, and mass thereto and applying bilinear transformation; and calculating the values of the mass as an arbitrary value, the damped natural frequency as a frequency of the harmonic overtone to be imitated, and the damping rate as an exponent used when the damping of the harmonic overtone is approximated by an exponential function.

8. The resonance generator according to claim 7, further comprising: multipliers connected in series to the respective digital filters of the resonance circuits, wherein the multipliers multiply amplitude ratios of harmonic overtones of a music sound including the harmonic overtones to be imitated by the digital filters as predetermined.

9. The resonance generator according to claim 1, wherein harmonic overtones to be imitated as the first resonance and the second resonance by the first resonance generating means and the second resonance generating means are extracted from waveform data as harmonic overtone components of the normal sound.

10. The resonance generator according to claim 1, wherein the normal sound generating means generates a normal sound by means of music sound synthesis, and harmonic overtones to be imitated by the first resonance signal and the second resonance signal are extracted from music sound waveforms synthesized according to predetermined music sound control information and outputted.

11. The resonance generator according to claim 1, wherein the resonance generating means have feedback paths which multiply outputs thereof as predetermined and add these to the normal sound signal, and feed-back and input these into the corresponding resonance generating means.

12. The resonance generator according to claim 11, wherein the feedback path includes a delay circuit for delaying the output of the music sound generating means and/or a filter for changing amplitude-frequency characteristics of the output.

13. The resonance generator according to claim 1, further comprising normal sound level lowering means for lowering a level of a normal sound to be outputted from the normal sound generating means in response to an operation on the damper operator.

14. The resonance generator according to claim 1, wherein the first resonance generating means and the second resonance generating means comprise a plurality of resonance circuit groups and a plurality of input sequences corresponding to the resonance circuit groups, and include adders which add and output resonance outputs of the resonance circuit groups.

15. The resonance generator according to claim 14, wherein the first resonance generating means and the second resonance generating means have a plurality of channels, and comprises multipliers which are provided as many as all pitch names for each channel to adjust an amplitude of a music sound based on music sound control information included in a sounding instruction, where in at least a multiplier of the same pitch name as that of the generated first resonance waveform data and second resonance waveform data, a multiplier coefficient different from that of other multipliers is set, and the resonance mixing means adds signals outputted from the multipliers of the respective channels corresponding to the same pitch name among the multipliers, and outputs of the adders are inputted into the resonance level control means.

16. The resonance generator according to claim 14, wherein the resonance circuits forming the resonance circuit group have resonance frequencies set to harmonic overtone frequencies of a music sound, and are connected in parallel as many as the harmonic overtone signals.

17. The resonance generator according to claim 14, wherein a resonance frequency of one resonance circuit is made correspondent to one harmonic overtone frequency, and on the other hand, when a plurality of harmonic overtones have harmonic overtone frequencies equal to or very close to each other, one of the harmonic overtone frequencies represents other harmonic overtone frequencies.

18. The resonance generator according to claim 14, wherein a resonance frequency of a resonance circuit corresponding to a planned harmonic overtone frequency is shifted a predetermined depth from the planned harmonic overtone frequency.

19. The resonance generator according to claim 14, wherein the number of input sequences of the first resonance generating means and the second resonance generating means corresponds to pitch names of the resonance circuit groups, and the number of distribution sequences is also the same number.

20. The resonance generator according to claim 14 wherein the resonance circuit group consists of a plurality of resonance circuits connected in parallel corresponding to harmonic overtones of a corresponding pitch name.

21. A resonance generator comprising:

first music sound component signal generating means for generating a first music sound component signal in response to a sounding instruction;

second music sound component signal generating means for generating a second music sound component signal in response to the sounding instruction;

normal sound signal mixing means for generating a normal sound signal by adding the first music sound component signal and the second music sound component signal having levels that are independent of an operation state of a damper operator;

resonating music sound level control means for controlling levels of the first music sound component signal and the second music sound component signal according to the operation state of the damper operator when the sounding instruction is inputted;

resonance generating means for generating a resonance signal based on the first music sound component signal and the second music sound component signal whose levels were controlled by the resonating music sound level control means;

resonance level control means for controlling the level of the resonance signal according to an operation depth of the damper operator; and resonance signal mixing means for adding the normal sound signal and the resonance signal whose level was controlled.

22. The resonance generator according to claim 21, wherein the first music sound component signal is composed of harmonic overtone components, and the second music sound component signal is composed of nonperiodic components.

23. The resonance generator according to claim 21, wherein the first music sound component signal is composed of nonperiodic components and harmonic overtone components, and the second music sound component signal is composed of harmonic overtone components by removing nonperiodic components from the nonperiodic components and harmonic overtone components.

24. The resonance generator according to claim 21, wherein the resonance generating means comprises a plurality of resonance circuit groups and a plurality of input sequences corresponding to the respective resonance circuit groups, and include adders which add and output resonance outputs of the respective resonance circuit groups.

25. The resonance generator according to claim 24, wherein the first music sound component signal generating means and the second music sound component signal generating means comprise:

a plurality of channels; and multipliers which are provided as many as all pitch names for each channel to adjust an amplitude of a music sound based on music sound control information included in a sounding instruction, among of which, in at least a multiplier of the same pitch name as that of the generated first music sound component signal and second music sound component signal, a multiplier coefficient different from that of other multipliers is set, and the adders add signals outputted from the multipliers of the respective channels corresponding to the same pitch name among the multipliers, and outputs of the adders are inputted into the resonance level control means.

26. The resonance generator according to claim 24, wherein the resonance circuits forming the resonance circuit group have resonance frequencies set to harmonic overtone frequencies of a music sound, and are connected in parallel as many as the harmonic overtones.

27. The resonance generator according to claim 26, wherein a resonance frequency of one resonance circuit is made correspondent to one harmonic overtone frequency, and when a plurality of harmonic overtones have harmonic overtone frequencies equal to or very close to each other, one of the harmonic overtone frequencies represent other harmonic overtone frequencies.

28. The resonance generator according to claim 26, wherein a resonance frequency of one resonance circuit is made correspondent to one harmonic overtone frequency, and a resonance frequency of a resonance circuit corresponding to a predetermined harmonic overtone frequency is shifted a predetermined depth from the predetermined harmonic overtone frequency.

29. The resonance generator according to claim 26, wherein the resonance generating means has a feedback path which multiplies an output thereof as predetermined, adds it to a normal sound signal, and feeds-back and inputs it into the resonance generating means.

30. The resonance generator according to claim 29, wherein in the feedback path, a delay circuit for delaying an output of the resonance generating means and/or a filter for changing amplitude-frequency characteristics of the output are provided.

31. The resonance generator according to claim 25, wherein the multipliers are provided as many as the pitch names of the resonance circuit groups per one channel, and multiplier coefficients of these multipliers are determined based on pitch information included in music sound control information, and a multiplier coefficient of one of the multipliers is set to be smaller than that of other multipliers, and multiplier coefficients of remaining multipliers are equal to each other.

32. The resonance generator according to claim 24, wherein the number of input sequences of the resonance generating means corresponds to pitch names of the resonance circuit groups, and the number of distribution sequences of the output channels of the music sound distributing means is also the same number.

33. The resonance generator according to claim 24, wherein the resonance circuit group consists of resonance circuits connected in parallel corresponding to harmonic overtones of a music sound of a corresponding pitch name.

34. The resonance generator according to claim 1 or 21, wherein the resonance generator is installed in an electronic keyboard instrument, and the sounding instruction is key-on data included in key information.

35. The resonance generator according to claim 31, wherein the resonance circuit group consists of resonance circuits connected in parallel corresponding to harmonic overtones of a music sound of a corresponding pitch name.

36. A resonance generator comprising:

first music sound component signal generating means for generating a first music sound component signal in response to a sounding instruction;

second music sound component signal generating means for generating a second music sound component signal in response to the sounding instruction;

normal sound signal mixing means for generating a normal sound signal by adding the first music sound component signal and the second music sound component signal having levels that are independent of an operation state of a damper operator;

resonating music sound level control means for controlling levels of the first music sound component signal and the second music sound component signal according to the operation state of the damper operator when the sounding instruction is inputted;

resonance generating means for generating a resonance signal based on the first music sound component signal and the second music sound component signal whose levels were controlled by the resonating music sound level control means;

resonance level control means for controlling the level of the resonance signal according to an operation depth of the damper operator; and resonance signal mixing means for adding the normal sound signal and the resonance signal whose level was controlled, wherein the resonance generating means comprises a plurality of resonance circuit groups and a plurality of input sequences corresponding to the respective resonance circuit groups, and include adders which add and output resonance outputs of the respective resonance circuit groups, wherein the resonance circuits forming the resonance circuit group have resonance frequencies set to harmonic overtone frequencies of a music sound, and are connected in parallel as many as the harmonic overtones, wherein the resonance circuit has a digital filter, and its impulse response is an imitation of a harmonic overtone oscillatory waveform by a single-degree-of-freedom viscous damping system model, and a filter coefficient to be used in the digital filter is determined by:

calculating a coefficient of viscosity and a coefficient of rigidity which become coefficients of a dynamic equation of the model by providing a mass, a damped natural frequency, and a damping rate as model parameters for determining the behavior of the single-degree-of-freedom viscous damping model;

calculating a filter coefficient of z-representation by Laplace-transforming the dynamic equation of the model to obtain a transfer function equation of s-representation and assigning the calculated coefficient of viscosity, coefficient of rigidity, and mass thereto and applying bilinear transformation; and calculating the values of the mass as an arbitrary value, the damped natural frequency as a frequency of the harmonic overtone to be imitated, and the damping rate as an exponent used when the damping of the harmonic overtone is approximated by an exponential function.

37. The resonance generator according to claim 36, further comprising: multipliers connected in series to the respective digital filters of the resonance circuits, wherein the multipliers multiply amplitude ratios of respective harmonic overtones of a music sound including the harmonic overtones to be imitated by the digital filters.

38. The resonance generator according to claim 36, wherein the first music sound component signal generating means and the second music sound component signal generating means generate a music sound by using stored music sound waveforms, and harmonic overtones to be imitated are harmonic overtones extracted from the stored music sound waveforms.

39. The resonance generator according to claim 36, wherein the first music sound component signal generating means and the second music sound component signal generating means generates a music sound by music sound synthesis, and harmonic overtones to be imitated are harmonic overtones extracted from music sound waveforms which are synthesized and outputted.

40. A resonance generator comprising:

a normal sound generator for generating a normal sound in response to a sounding instruction;

a first resonance generator for generating first resonance;

a second resonance generator for generating second resonance;

a switch for selecting the first resonance generator when a damper operator is operated when the sounding instruction is inputted, and selecting the second resonance generator when the damper operator is not operated when the sounding instruction is inputted;

a level controller for controlling levels of the first resonance and the second resonance according to an operation depth of the damper operator; and a resonance mixer for adding the normal sound and either resonance selected of the first resonance or the second resonance by the switch, wherein the first resonance is resonance when the damper operator is operated before inputting of the sounding instruction, and the second resonance is resonance when the damper operator is operated after inputting of the sounding instruction.

* * * * *